US010843863B2

(12) United States Patent
Morine et al.

(10) Patent No.: US 10,843,863 B2
(45) Date of Patent: Nov. 24, 2020

(54) FOOD AND BEVERAGE COOLER ASSEMBLY

(71) Applicant: OTTER PRODUCTS, LLC, Fort Collins, CO (US)

(72) Inventors: Alan V. Morine, Fort Collins, CO (US); Matthew M. Glanzer, Fort Collins, CO (US); Todd Eichinger, Fort Collins, CO (US); Cory R. Bloor, Westminster, CO (US); Jonathan B. Rayeski, Fort Collins, CO (US)

(73) Assignee: OTTER PRODUCTS, LLC, Fort Collins, CO (US)

( * ) Notice: Subject to any disclaimer, the term of this patent is extended or adjusted under 35 U.S.C. 154(b) by 837 days.

(21) Appl. No.: 15/398,468

(22) Filed: Jan. 4, 2017

(65) Prior Publication Data

US 2018/0186550 A1 Jul. 5, 2018

(51) Int. Cl.

| | |
|---|---|
| ***B65D 81/38*** | (2006.01) |
| ***F25D 3/06*** | (2006.01) |
| ***A45C 11/20*** | (2006.01) |
| ***B65D 43/16*** | (2006.01) |
| ***F25D 3/08*** | (2006.01) |

(52) U.S. Cl.

CPC ..... *B65D 81/3813* (2013.01); *A45C 11/20* (2013.01); *B65D 43/16* (2013.01); *B65D 81/3816* (2013.01); *B65D 81/3823* (2013.01); *F25D 3/06* (2013.01); *F25D 3/08* (2013.01)

(58) Field of Classification Search

CPC . B65D 25/20; B65D 21/0204; B65D 21/0201

USPC ..... 220/23.4, 915.2, 23.83, 4.01, 4.27; 224/191, 269, 242

See application file for complete search history.

(56) References Cited

U.S. PATENT DOCUMENTS

| | | | |
|---|---|---|---|
| 1,468,563 | A | 9/1923 | Girard |
| 2,627,993 | A | 2/1953 | Hafner |

(Continued)

FOREIGN PATENT DOCUMENTS

| | | | |
|---|---|---|---|
| EP | 3061704 | A1 | 8/2016 |
| WO | 2004029526 | A1 | 4/2004 |

(Continued)

OTHER PUBLICATIONS

Pelican Consumer, Coolers—Hunting, Fishing, Camping, downloaded from http://www.pelican.com/us/en/products/coolers May 8, 2017, 2 pages.

(Continued)

*Primary Examiner* — Fenn C Mathew
*Assistant Examiner* — Jennifer Castriotta

(57) ABSTRACT

A cooler assembly for the storage of one or more objects includes a cooler portion having a main portion and a cover portion that is removably or pivotable relative to the main portion. First and second main portion securement features are disposed on a side wall of the main portion, and the first and second main portion securement features may be identical. First and second attachment assemblies, which may include a container, have identical first and second attachment securement features, respectively, which may releasably engage either of the first and second main portion securement features to allow the first and second attachment assemblies to be transported with and stored on the cooler portion.

38 Claims, 23 Drawing Sheets

(56) References Cited

U.S. PATENT DOCUMENTS 3,395,550 A 8/1968 Dungan
3,850,398 A 11/1974 Kantor
3,868,829 A 3/1975 Kemper
3,939,986 A 2/1976 Pierro
4,024,731 A 5/1977 Branscum
4,213,310 A 7/1980 Buss
D275,822 S 10/1984 Gatland et al.
4,515,421 A 5/1985 Steffes
4,560,128 A 12/1985 Willeby et al.
RE32,740 E 8/1988 Steffes
4,841,661 A * 6/1989 Moore ..... A01K 97/06 222/130
4,964,528 A 10/1990 Wagoner
4,988,216 A 1/1991 Lyman
5,052,185 A 10/1991 Spahr
D325,323 S 4/1992 Kahl
5,103,884 A * 4/1992 Roman ..... A45F 5/02 150/134
D328,389 S 8/1992 Pardo
D330,488 S 10/1992 Daniels
5,181,612 A 1/1993 Liu
5,285,656 A 2/1994 Peters
D353,082 S 12/1994 Keven
D354,419 S 1/1995 Kahl et al.
5,403,095 A 4/1995 Melk
5,605,056 A 2/1997 Brown et al.
D387,249 S 12/1997 Mogil
5,816,432 A 10/1998 Hammen et al.
5,845,515 A 12/1998 Nelson
5,850,915 A * 12/1998 Tajima ..... H04B 1/08 206/320
D419,297 S 1/2000 Richardson et al.
D419,767 S 2/2000 Richardson et al.
D419,768 S 2/2000 Richardson et al.
6,039,202 A 3/2000 Olstad et al.
D425,761 S 5/2000 Philipson et al.
6,065,873 A 5/2000 Fowler
D435,196 S 12/2000 Gregor et al.
6,185,860 B1 2/2001 Thibodeaux
6,193,097 B1 2/2001 Perianes
6,244,458 B1 6/2001 Frysinger et al.
D444,683 S 7/2001 Corrion
D451,765 S 12/2001 Israel et al.
6,328,179 B1 12/2001 Conrado et al.
D455,934 S 4/2002 Culp et al.
6,505,479 B2 1/2003 Defelice et al.
D472,384 S 4/2003 Richardson
6,595,687 B2 7/2003 Godshaw et al.
6,751,963 B2 6/2004 Navedo et al.
D502,599 S 3/2005 Cabana et al.
6,895,778 B1 5/2005 Ackerman
D513,123 S 12/2005 Richardson et al.
D514,808 S 2/2006 Morine et al.
6,993,931 B1 * 2/2006 Hamilton ..... A45B 23/00 62/371
D516,807 S 3/2006 Richardson et al.
D527,226 S 8/2006 Maldonado
D527,953 S 9/2006 Gal
7,140,507 B2 11/2006 Maldonado et al.
7,296,433 B2 11/2007 Uihlein et al.
7,389,608 B1 * 6/2008 MacKay ..... A01K 97/05 206/315.11
7,415,794 B1 8/2008 Thompson
7,682,080 B2 3/2010 Mogil
D635,832 S 4/2011 Bergin
D637,044 S 5/2011 Davis
8,043,004 B2 10/2011 Mogil
8,065,889 B1 11/2011 Silberman
8,246,190 B2 8/2012 Boiteau et al.
D712,720 S 9/2014 Seiders
D712,721 S 9/2014 Seiders
D712,722 S 9/2014 Seiders
D712,723 S 9/2014 Seiders
D714,125 S 9/2014 Seiders
8,863,546 B2 10/2014 Oberweis
8,910,819 B2 12/2014 Seiders
8,925,752 B2 * 1/2015 Smith ..... F25D 3/08 220/23.4
D722,474 S 2/2015 Seiders
D722,475 S 2/2015 Seiders
D732,348 S 6/2015 Seiders et al.
D732,349 S 6/2015 Seiders et al.
D732,350 S 6/2015 Seiders et al.
D732,899 S 6/2015 Seiders et al.
9,139,352 B2 9/2015 Seiders et al.
9,187,232 B2 11/2015 Seiders
D752,347 S 3/2016 Seiders et al.
9,316,428 B2 4/2016 Mech
9,389,010 B1 7/2016 Booker
9,408,445 B2 8/2016 Mogil et al.
9,433,200 B2 * 9/2016 Norman ..... A01K 97/08
9,446,847 B2 9/2016 Richardson et al.
9,500,400 B2 11/2016 Smith
9,834,342 B2 4/2017 Seiders
D786,559 S 5/2017 Seiders et al.
D786,560 S 5/2017 Seiders et al.
D786,561 S 5/2017 Seiders et al.
D786,562 S 5/2017 Seiders et al.
D787,187 S 5/2017 Seiders et al.
D797,454 S 9/2017 Seiders et al.
D797,455 S 9/2017 Seiders et al.
D798,670 S 10/2017 Seiders et al.
D799,276 S 10/2017 Seiders et al.
D799,277 S 10/2017 Seiders et al.
D799,905 S 10/2017 Seiders et al.
D801,123 S 10/2017 Seiders et al.
9,796,517 B2 10/2017 Seiders et al.
D802,373 S 11/2017 Seiders et al.
D804,905 S 12/2017 Seiders et al.
D805,851 S 12/2017 Seiders et al.
D820,646 S 6/2018 Yockey
D821,825 S 7/2018 Sullivan et al.
10,029,842 B2 7/2018 Seiders et al.
10,092,137 B1 10/2018 Nelson et al.
10,221,005 B2 3/2019 James
D850,865 S 6/2019 Smith et al.
10,351,330 B2 7/2019 Smith et al.
10,392,180 B1 8/2019 Travis et al.
10,443,918 B2 10/2019 Li et al.
2003/0038138 A1 2/2003 Komurke
2003/0141424 A1 7/2003 Thomas
2004/0178208 A1 9/2004 Leba et al.
2004/0238543 A1 12/2004 Askew
2004/0262319 A1 12/2004 Fisher
2005/0006268 A1 1/2005 Futernick
2005/0133557 A1 * 6/2005 McKenzie ..... B60R 11/00 224/547
2005/0263527 A1 12/2005 Maldonado et al.
2005/0279124 A1 12/2005 Maldonado
2006/0180624 A1 * 8/2006 Sadow ..... A45C 7/009 224/582
2007/0137958 A1 6/2007 Hamlin
2007/0278234 A1 12/2007 Mogil
2008/0094853 A1 4/2008 Kim et al.
2008/0260303 A1 10/2008 Lesseux et al.
2009/0159471 A1 * 6/2009 Koppe ..... A45F 5/02 206/242
2010/0072215 A1 * 3/2010 Coon ..... A45C 13/30 220/735
2010/0287976 A1 11/2010 Roof et al.
2011/0056233 A1 3/2011 Flaker et al.
2011/0182532 A1 7/2011 Baltus
2011/0203297 A1 8/2011 Oberweis
2011/0220531 A1 9/2011 Meether et al.
2011/0289958 A1 12/2011 White et al.
2013/0264161 A1 10/2013 Thompson
2014/0013789 A1 1/2014 Conrad et al.
2015/0158539 A1 6/2015 Jensen et al.
2015/0210444 A1 7/2015 Mercado et al.
2015/0241107 A1 * 8/2015 Mech ..... F25D 3/08 220/592.01
2015/0369529 A1 12/2015 Monroe
2016/0101924 A1 4/2016 Mitchell et al.

(56) References Cited

U.S. PATENT DOCUMENTS

| | | | | |
|---|---|---|---|---|
| 2016/0257479 | A1 | 9/2016 | Seiders et al. | |
| 2016/0279840 | A1 | 9/2016 | French et al. | |
| 2016/0347507 | A1* | 12/2016 | Kendrick | B65D 25/34 |
| 2017/0001785 | A1 | 1/2017 | Ripley et al. | |
| 2017/0023289 | A1 | 1/2017 | Anderson | |
| 2017/0073146 | A1 | 3/2017 | Kuhn et al. | |
| 2017/0073147 | A1 | 3/2017 | Kuhn | |
| 2017/0233139 | A1 | 8/2017 | Averill | |
| 2017/0245486 | A1 | 8/2017 | Larson et al. | |
| 2017/0305639 | A1 | 10/2017 | Kuhn et al. | |
| 2017/0350635 | A1 | 12/2017 | Thirumurugavel | |
| 2018/0015938 | A1* | 1/2018 | DeFrancia | A45C 13/02 |
| 2018/0141718 | A1 | 5/2018 | Ahlström et al. | |
| 2018/0149400 | A1 | 5/2018 | Valencia | |
| 2018/0263346 | A1 | 9/2018 | Stephens | |
| 2018/0290814 | A1 | 10/2018 | Smith | |
| 2018/0346229 | A1 | 12/2018 | Guerdrum et al. | |
| 2018/0353379 | A1 | 12/2018 | Chou et al. | |
| 2019/0023480 | A1 | 1/2019 | Lin | |

FOREIGN PATENT DOCUMENTS

| | | | |
|---|---|---|---|
| WO | 2006007266 | A2 | 1/2006 |
| WO | 2006009537 | A1 | 1/2006 |
| WO | 2014105962 | A1 | 7/2014 |
| WO | 2016154105 | A1 | 9/2016 |

OTHER PUBLICATIONS

RTIC, Cooler Accessories, downloaded May 8, 2017 from http://www.rticcoolers.com/shop/coolers/accessories, 14 pages.

Yeti Coolers, Tundra Cooler Divider, downloaded from www.yeti.com/tundra-dividers May 8, 2017, 4 pages.

Yeti Coolers, Tundra Ice Chests, downloaded from http://yeti.com/tundra May 8, 2017, 7 pages.

Yeti Coolers, Yeti Accessories & Parts, downloaded from http://yeti.com/accessories May 8, 2017, 5 pages.

amazon.com, "Farberware 5190590 3-piece cutting board set," dated Jul. 23, 2011, downloaded from https ://www.amazon.com/Farberware-5190590-3-Piece-Plastic-Assorted/dp/80731KDNM P/ref=cm_cr_arp _d_product_top?ie=UTF8 Mar. 11, 2019, 8 pages.

Yeti Coolers, "Tundra Cooler Divider," dated Mar. 11, 2014, downloaded from https://www.yeti.com/en_US/accessories/tundra-dividers/DV.html?cg id =accessories# Mar. 11, 2019, 9 pages.

Digital Trends, "The new Venture coolers from Otterbox . . . ", Posted May 9, 2017.(https://www.digitaltrends.com/outdoors/otterbox-venture-coolers/).

OtterBox, "Rugged Venture Coolers", Accessed Jan. 16, 2018. (https://www.otterbox.com/en-us/venture-coolers.html).

Pelican Products, "70QT Cooler", Accessed Jan. 16, 2018. (http://www.pelican.com/usien/product/outdoor-heavy-dutycoolers/elite-cooler/cooler/70QT/).

The Cooler Box, "Cordova Coolers vs Yeti—Is This New Cooler Better Than Yeti?", Published Oct. 24, 2016.(http://thecoolerbox.com/cordova-coolers-vs-yeti/).

* cited by examiner

FOOD AND BEVERAGE COOLER ASSEMBLY

FIELD OF THE DISCLOSURE

This disclosure relates generally to a cooler for storing objects, such as food and/or beverages.

BACKGROUND

When participating in many leisure activities, it is often desired to bring along food or beverages for consumption before, during, and/or after the activity. Often, the food may be perishable and the ambient temperature may be high (for instance, at a beach location), so it is desired to keep the perishable food in a temperature-controlled environment to avoid spoiling. Similarly, beverages (such as canned beverages) may also be consumed, and it is desired to keep such beverages cool until consumption. Typically, a cooler may be used to transport the food and beverages while maintaining them in a temperature-controlled environment. The cooler typically has a main portion and a cover portion removably secured to the main portion, and the main portion has side walls and a bottom wall that may be insulated. Ice and/or cooling packs may be placed in an interior portion of the cooler defined by the side walls and bottom wall to keep the interior portion of the cooler at a desired temperature that is lower than the ambient temperature.

Typically, all food and beverage items are placed in the interior portion of the cooler, where they are subjected to the same bed of ice and/or cooling packs, and therefore all items are maintained at approximately the same temperature. In addition, the food and beverage items may tend to shift during transport of the cooler, making the interior portion disorganized and obscuring the type of items in the interior portion. There is therefore a need to organize items in a cooler to simplify identification of the items and maintain order in the interior portion of the cooler.

Often, items are also transported along with the cooler that are related to the activity and/or consumption of the foods and beverages in the interior portion of the cooler. For example, bottle openers, napkins, utensils, tongs, cups, radios, speakers, etc. may be transported to the leisure activity with the cooler. However, these additional items are often gathered prior to the activity and may be forgotten when departing for the activity. In addition, the items may be left in a vehicle that is remote from the leisure activity and cooler, resulting in time wasted to retrieve the items left behind. Moreover, due to the haphazard nature in which the items are transported from a vehicle to a final location for the leisure activity, items could be dropped or lost along the way. Accordingly, there is a need for a cooler assembly that provides accessories (such as containers for items) that can be removably and reliably secured to the cooler such that items can be stored with the cooler and will not be lost or misplaced prior to their use.

BRIEF SUMMARY OF THE DISCLOSURE

A cooler assembly for the storage of one or more objects includes a cooler portion, and the cooler portion has a main portion having side walls having one or more interior surfaces that cooperate to at least partially define an interior portion that is adapted to receive the one or more objects. One or more exterior surfaces of the side walls of the main portion define an exterior portion of the main portion. The cooler portion also includes a cover portion at least one of pivotably coupled to or removably secured to the main portion, and when the cover portion is in a closed position relative to the main portion, one or more interior surfaces of the cover portion cooperate to at least partially define the interior portion. The cooler portion additionally includes a first main portion securement feature disposed at a first location on at least one of the one or more side walls of the main portion. The cooler portion further includes a second main portion securement feature disposed at a second location on at least one of the one or more side walls of the main portion, and the first main portion securement feature is identical to the second main portion securement feature. The cooler assembly includes a first attachment assembly, the first attachment assembly having a first attachment securement feature adapted to releasably engage the first main portion securement feature or the second main portion securement feature to removably secure the first attachment assembly to at least one of the one or more side walls of the main portion. The cooler assembly also includes a second attachment assembly, the second attachment assembly having a second attachment securement feature adapted to releasably engage the first main portion securement feature or the second main portion securement feature to removably secure the second attachment assembly to at least one of the one or more side walls of the main portion.

DETAILED DESCRIPTION

Figure 1:
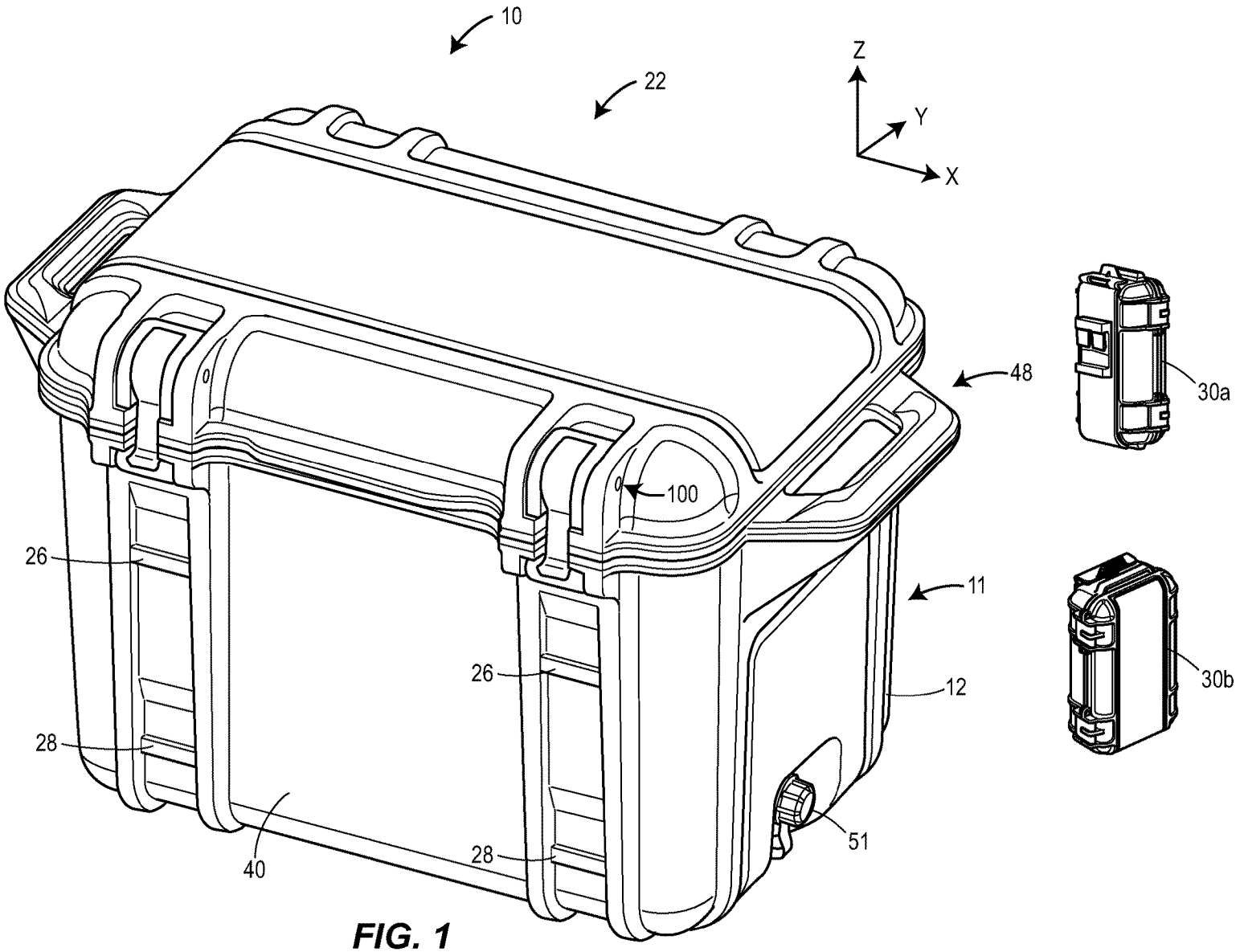
FIG. 1 is a perspective view of an embodiment of a cooler assembly.

FIG. 1 illustrates a perspective view of a cooler assembly 10 that includes a cooler portion 11 having a main portion 12 and a cover portion 22. As shown in the perspective view of an embodiment of the main portion 12 illustrated in FIG. 2A, the main portion 12 may have one or more side walls 40 having one or more interior surfaces 14 that cooperate to at least partially define an interior portion 16 that is adapted to receive the one or more objects (not shown). Referring again to FIG. 1, the one or more side walls 40 of the main portion 12 may also include one or more exterior surfaces 18 that may define an exterior portion 20 of the main portion 12 or the cooler portion 11. The cover portion 22 of the cooler portion 11 may be at least one of pivotably coupled to or removably secured to the main portion 12. When the cover portion 22 is in a closed position relative to the main portion 12, as illustrated in FIG. 1, one or more interior surfaces 24 of the cover portion 22 (shown in a bottom view of an embodiment of the cover portion 22 in FIG. 7B) may cooperate to at least partially further define the interior portion 16. As illustrated in FIG. 1, the cooler portion 11 may also include a first main portion securement feature 26 disposed at a first location on at least one of the one or more side walls 40 of the main portion 12. The cooler portion 11 may additionally include a second main portion securement feature 28 that may be disposed at a second location on at least one of the one or more side walls 40 of the main portion 12, and the first main portion securement feature 26 may be identical or substantially identical to the second main portion securement feature 28.

Figure 4A:
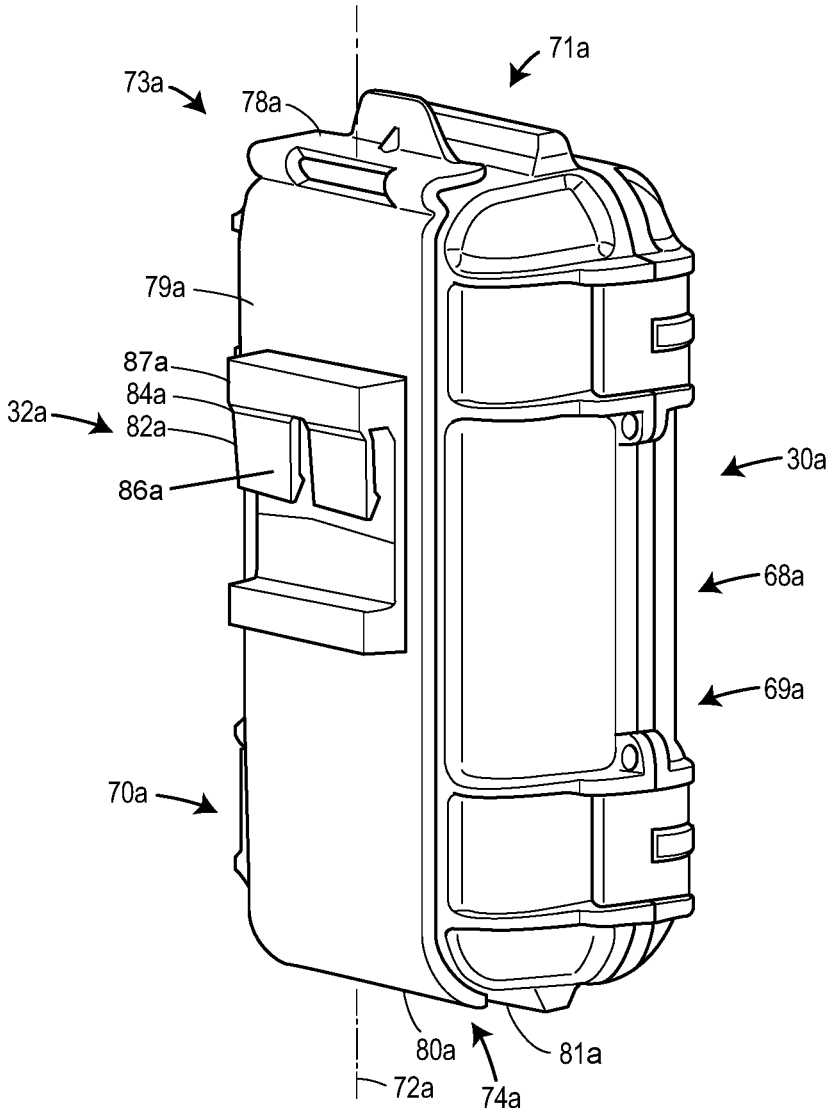
FIG. 4A is a perspective view of an embodiment of the first attachment assembly.
Figure 5:
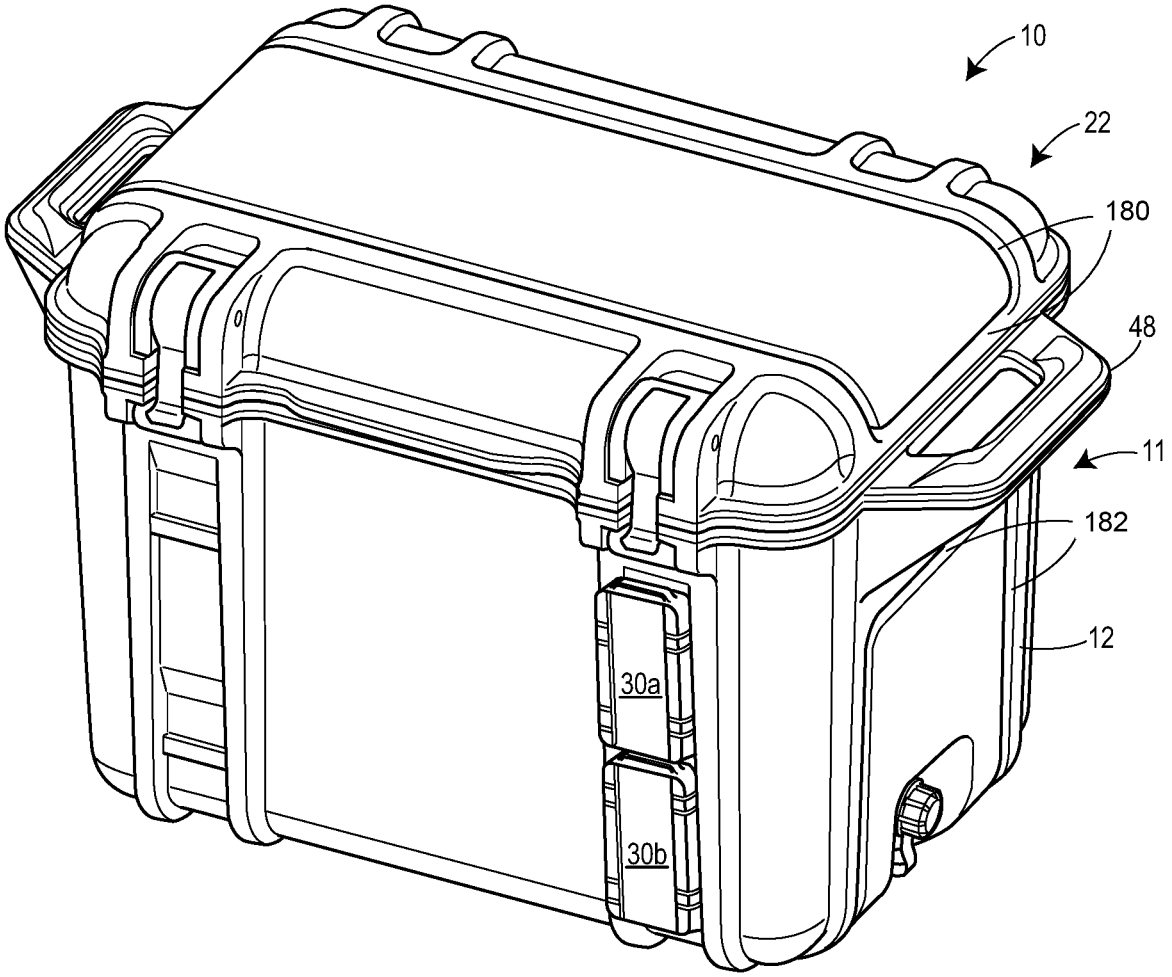
FIG. 5 is a perspective view of the cooler assembly with the first attachment assembly secured to the first main portion securement feature and the second attachment assembly secured to the second main portion securement feature.
Figure 6:
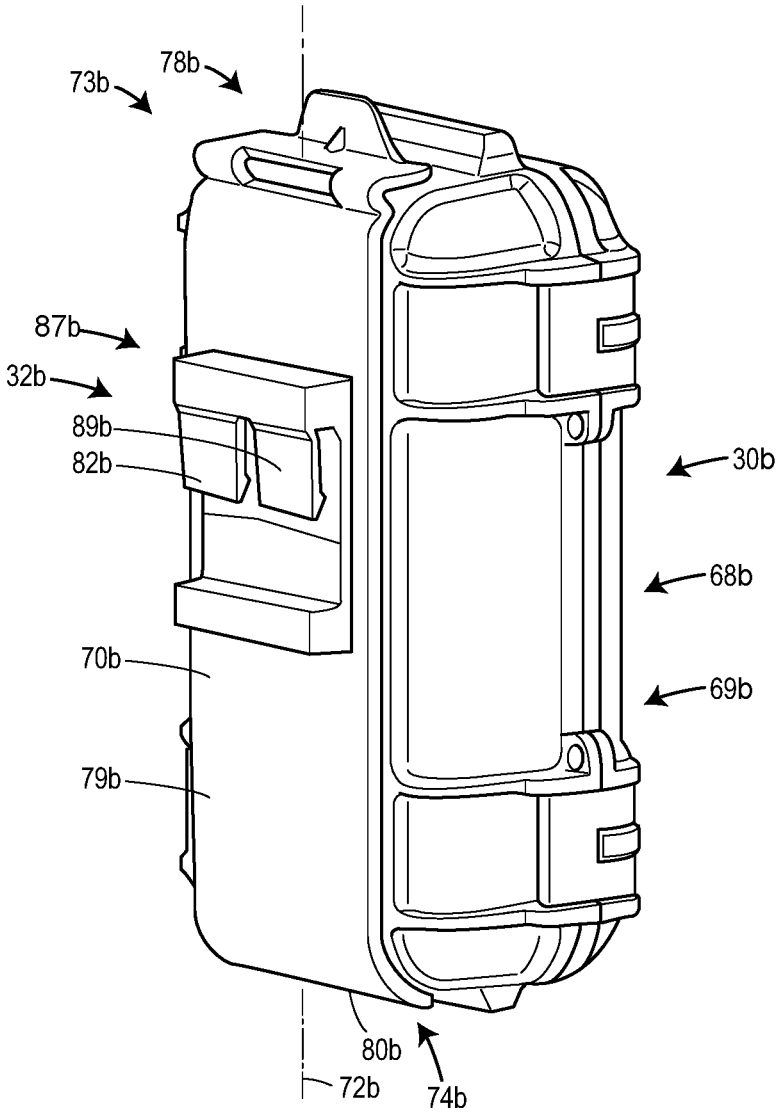
FIG. 6 is a perspective view of an embodiment of the second attachment assembly.

As illustrated in FIG. 5, which illustrates a perspective view of the cooler assembly 10, the cooler assembly 10 may further include a first attachment assembly 30*a*. As shown in FIG. 4A, which provides a perspective view of the first attachment assembly 30*a*, the first attachment assembly 30*a* has a first attachment securement feature 32*a* that releasably engages (or is adapted to releasably engage) the first main portion securement feature 26 or the second main portion securement feature 28 to removably secure the first attachment assembly 30*a* to one or more exterior surfaces 18 of the main portion 12 of the cooler portion 11, as illustrated in FIG. 5. Referring again to FIG. 1, the cooler assembly 10 may additionally include a second attachment assembly 30*b*. As shown in FIG. 6, which provides a perspective view of the second attachment assembly 30*b*, the second attachment assembly 30*b* may have a second attachment securement feature 32*b* that releasably engages (or is adapted to releasably engage) the first main portion securement feature 26 or the second main portion securement feature 28 to removably secure the second attachment assembly 30*b* to one or more exterior surfaces 18 of the main portion 12 of the cooler portion 11, as illustrated in FIG. 5. The first attachment securement feature 32*a* may be identical or substantially identical to the second attachment securement feature 32*b*.

So configured, the cooler portion 11 (and the cooler assembly 10) may be used as a conventional "cooler" to keep food and beverages stored in the interior portion 16 cool relative to a high (or moderately high) ambient temperature on the exterior portion 20. However, it is contemplated that the cooler portion 11 (and the cooler assembly 10) may have any other suitable use or application in which some measure of insulation or temperature stability is desired. For example, the cooler portion 11 (and the cooler assembly 10) may be used to keep food and beverages stored in the interior portion 16 warm or hot relative to a low or moderately low ambient temperature on the exterior portion 20. In other examples, the cooler portion 11 (and the cooler assembly 10) may be used to keep items that are not foods or beverages (such as temperature sensitive pharmaceuticals or tissues) stored in the interior portion 16 at a desired temperature (e.g., cool, warm, or hot) relative to an ambient temperature on the exterior portion 20.

Also as configured, the first attachment assembly 30*a* having the first attachment securement feature 32*a* and the second attachment assembly 30*b* having the second attachment securement feature may be removably secured to either of the first main portion securement feature 26 or the second main portion securement feature 28 to allow the first attachment assembly 30*a* and/or the second attachment assembly 30*b* to be quickly, conveniently, and reliably coupled and uncoupled to the cooler portion 11 in a manner that will be described in more detail below.

In other examples, the cooler portion 11 (and the cooler assembly 10) may be used as a storage container that is not necessarily utilized for maintaining the temperature of its contents. For example, the cooler portion 11 (and the cooler assembly 10) may be used to store one or more items to protect them from the elements, to protect them from water, to protect them from dust, to protect them from snow, to protect them from impact, to protect them from shock, to protect them from chemicals, to secure them from theft, and/or to control access to the one or more items. In these applications, the wall thickness of the cooler portion 11 may be thinner than the wall thickness of insulating embodiments. Further, in these applications, other features may be modified such as, for example, reducing or eliminating insulating materials in the walls and/or eliminating spout member 51.

Figure 2A:
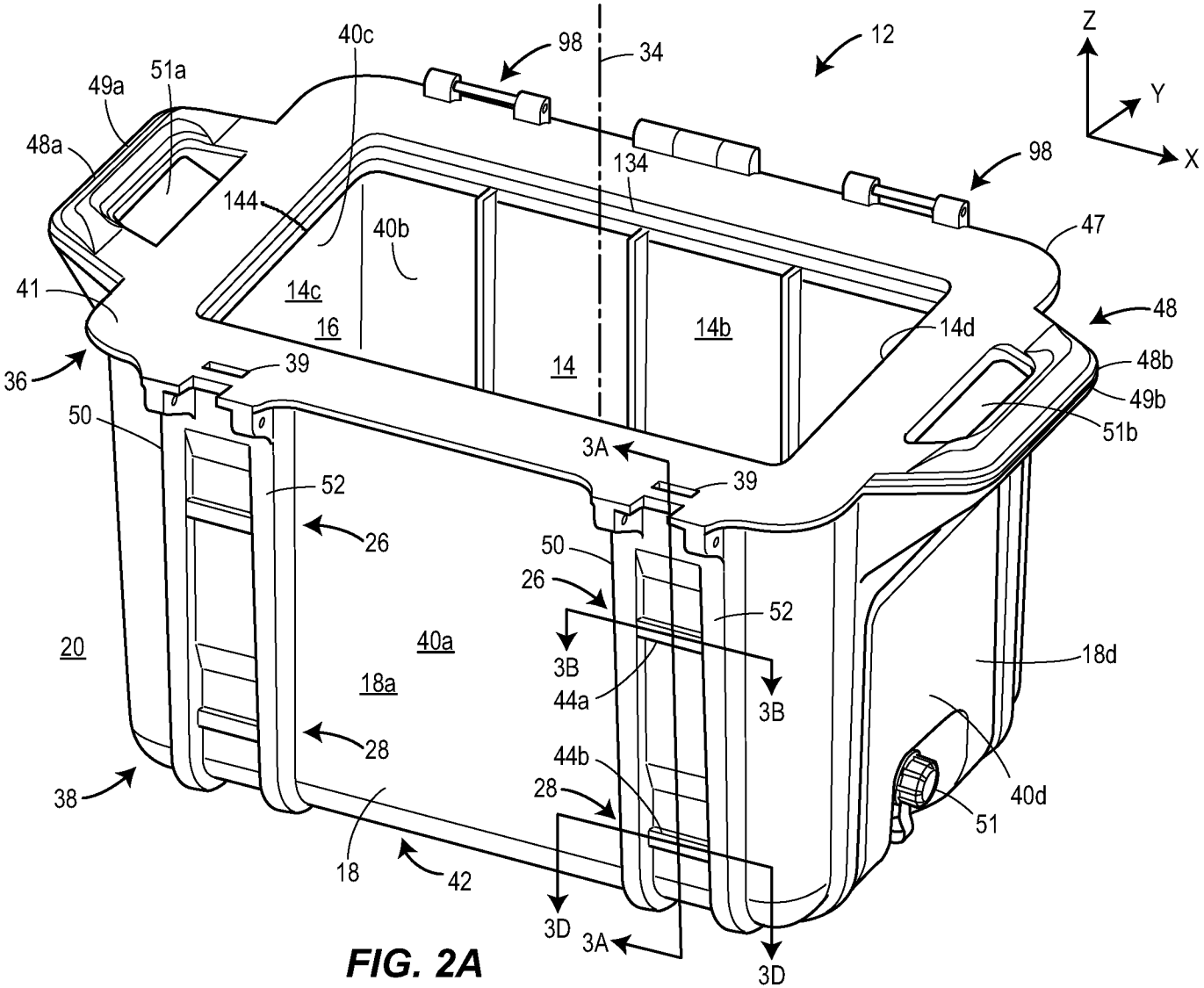
FIG. 2A is a perspective view of an embodiment of a main portion of a cooler portion of an embodiment of a cooler assembly.
Figure 2B:
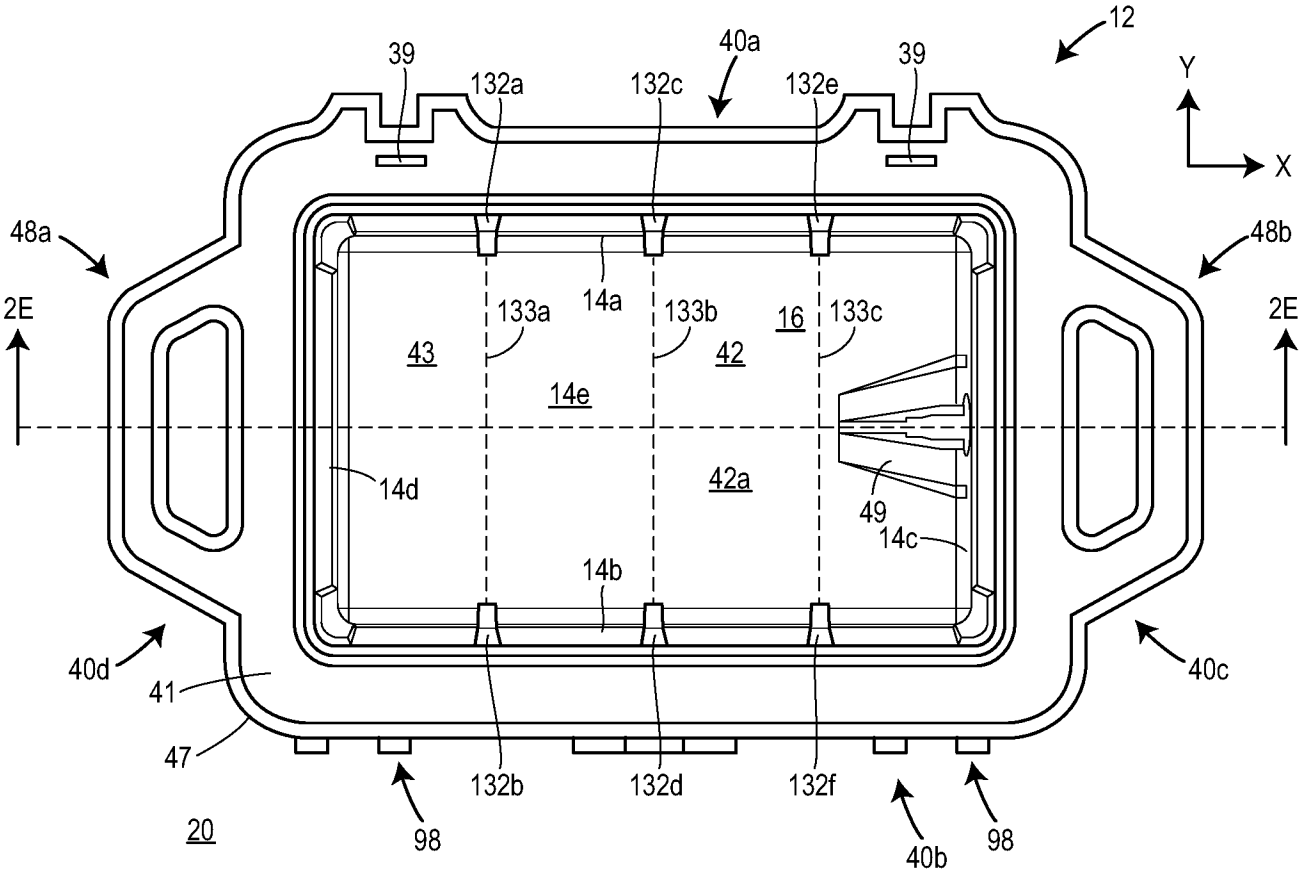
FIG. 2B is a top view of the embodiment of the main portion of FIG. 2A.

Turning to the cooler assembly 10 in more detail, and with reference to FIG. 2A, the main portion 12 of the cooler portion 11 may extend along a main portion axis 34 from a first end 36 of the main portion 12 to a second end 38 of the main portion 12. In some embodiments, the main portion axis 34 may extend in a direction parallel to the Z-axis of the reference coordinate system of FIG. 2A, and the main portion axis 34 may be disposed in a vertical orientation such that the cooler portion 11 is upright when in use. The main portion 12 may include one or more side walls 40 that may each extend in a direction generally along the main portion axis 34 from the first end 36 to the second end 38. The one or more side walls 40 may be defined by one or more of the one or more interior surfaces 14 and by one or more of the one or more exterior surfaces 18. In some embodiments, the main portion 12 may include one or more bottom walls 42 that may extend between the one or more side walls 40 at the second end 38 of the main portion 12. As illustrated in the top view of the main portion 12 illustrated in FIG. 2B, the one or more bottom walls 42 may include one or more interior surfaces 43 that may cooperate to further define the interior portion 16. In some embodiments, the one or more bottom walls 42 may extend normal (or substantially normal) to the main portion axis 34. As illustrated in FIG. 2B, a recess 49 may be defined in one or more interior surfaces 43 to channel liquids or beverages stored in the interior portion 16 through a spout member 51 (illustrated in FIG. 1).

Figure 7A:
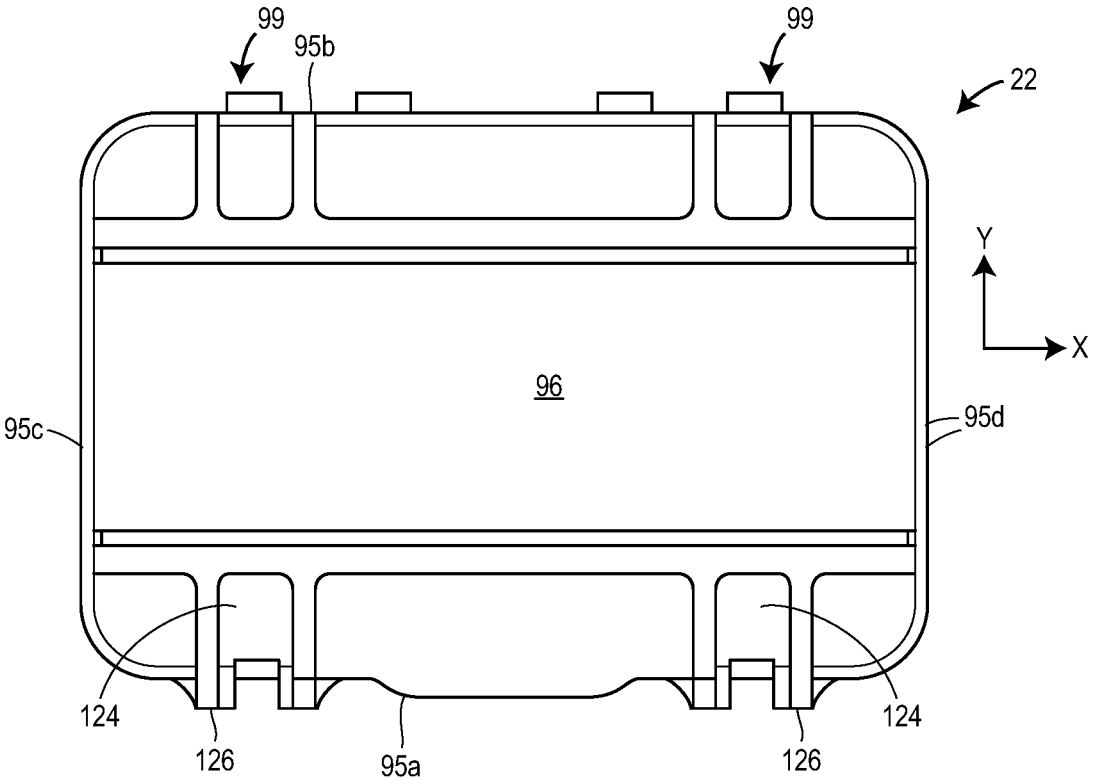
FIG. 7A is a top view of an embodiment of a cover portion of the cooler portion of the cooler assembly.
Figure 7B:
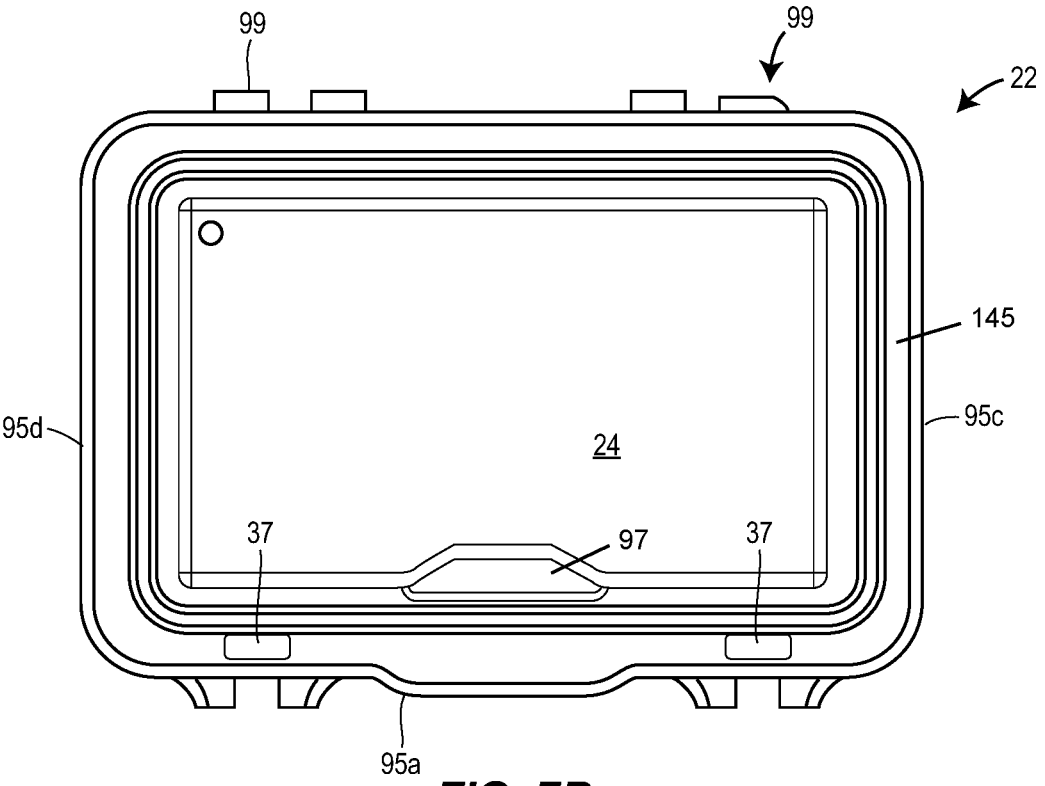
FIG. 7B is a bottom view of the embodiment of the cover portion 22 of FIG. 7A.
Figure 8:
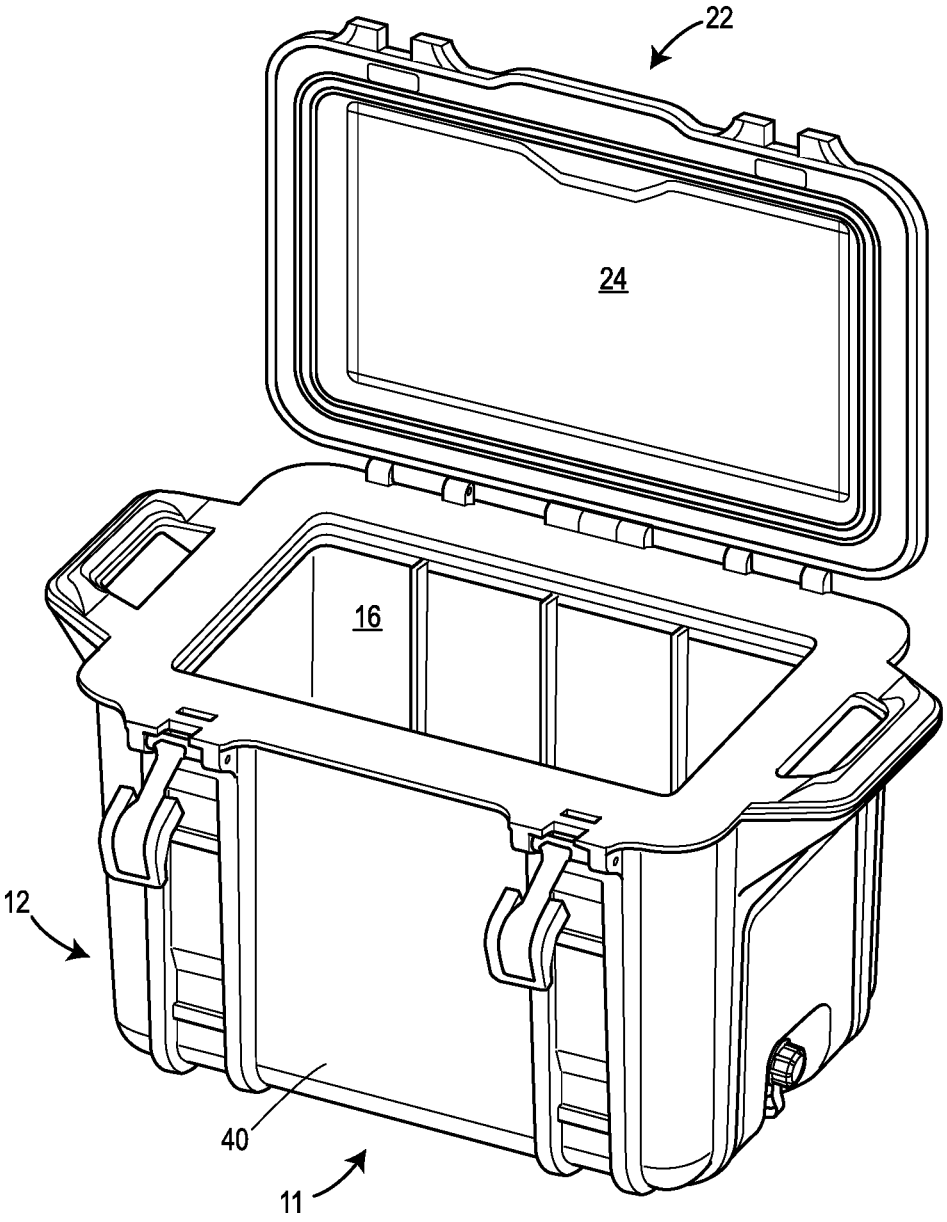
FIG. 8 is a perspective view of an embodiment of the cooler portion having the cover portion in the open position.

So configured, and as illustrated in FIG. 2A, the one or more side walls 40 and one or more bottom walls 42 may provide an open first end 36 of the main portion 12 to allow objects to be placed into the interior portion 16 when the cover portion 22 is not secured to the main portion 12 (or if the cover portion 22 is rotated into an open position if the cover portion 22 is pivotably coupled to the main portion 12, as illustrated in the embodiment of the cooler portion 11 shown in FIG. 8). As illustrated in FIG. 2A, the main portion 12 may include an upper surface 41 that may extend along the open first end 36 of the main portion 12, and the upper surface 41 may extend between the one or more interior surfaces 14 and the one or more exterior surfaces 18 of the one or more side walls 40. The upper surface 41 may have any suitable shape, and the upper surface 41 may be planar or substantially planar. The upper surface 41 may provide a surface in which a bottom portion of the cover portion 22 may engage when the cover portion 22 is in the closed position of FIG. 1. As illustrated in FIG. 2A, one or more protrusions 39 may be disposed on the upper surface 41, and each protrusion 39 is adapted to be disposed in a corresponding recess 37 in the cover portion 22 (see FIG. 7B) to maintain proper alignment of the cover portion 22 relative to the main portion 12 when the cover portion 22 is in the closed position of FIG. 1.

Figure 2D:
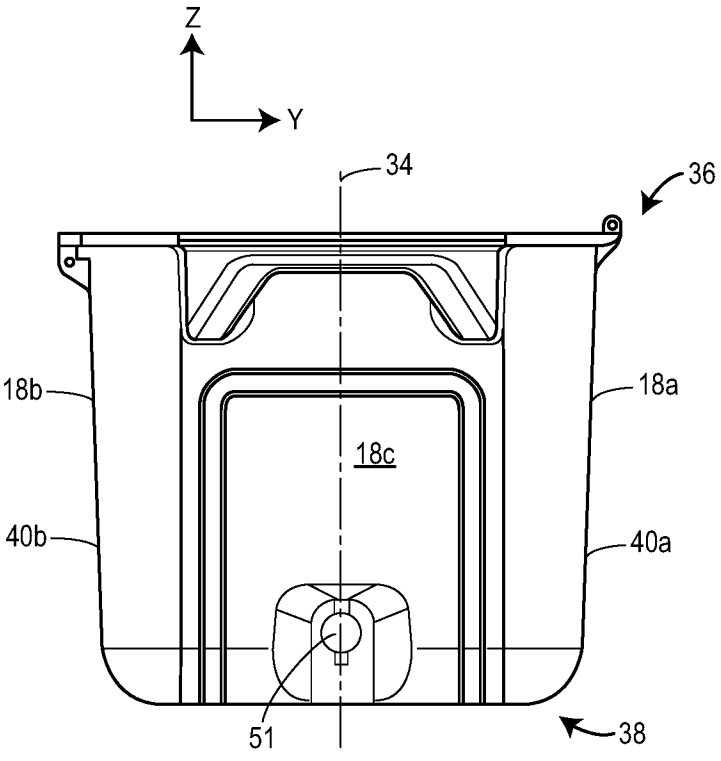
FIG. 2D is a side view of the embodiment of the main portion of FIG. 2A.

In some embodiments, the one or more side walls 40 of the main portion 12 may include four side walls 40 that may form or cooperate to form a rectangular (or generally rectangular) shape when viewed along the main portion axis 34, as illustrated in FIG. 2B. More specifically, the one or more side walls 40 may include a first side wall 40*a* and a second side wall 40*b* offset from the first side wall 40*a* in a direction parallel to the Y-axis of the reference coordinate system of FIG. 2B. The one or more side walls 40 may further include a third side wall 40*c* and a fourth side wall 40*d* offset from the third side wall 40*c* in a direction parallel to the X-axis of the reference coordinate system of FIG. 2B. The first side wall 40*a* and the second side wall 40*b* may be parallel or may converge from the first end 36 to the second end 38, as illustrated in the side view of the main portion 12 provided in FIG. 2D. The third side wall 40*c* and the fourth side wall 40*d* may be parallel or may converge from the first end 36 to the second end 38, as illustrated in the front view of the main portion 12 provided in FIG. 2C. The one or more bottom walls 42 may include a first bottom wall 42*a* that may extend in a direction generally parallel to the X-Y plane of the reference coordinate system of FIG. 2B. As illustrated in FIG. 2B, the first bottom wall 42*a* may extend from the first side wall 40*a*, the second side wall 40*b*, the third side wall 40*c*, and the fourth side wall 40*d* at the second end 38 of the main portion 12.

Figure 2C:
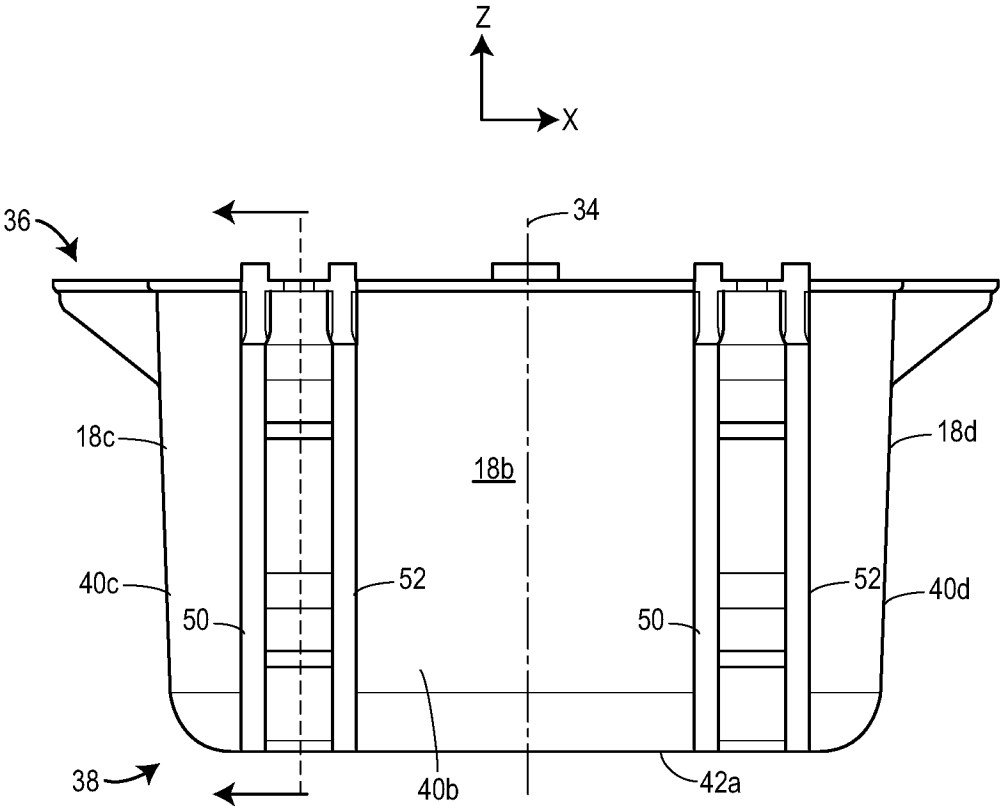
FIG. 2C is a front view of the embodiment of the main portion of FIG. 2A.

Still referring to FIG. 2B, the first side wall 40*a*, the second side wall 40*b*, the third side wall 40*c*, and the fourth side wall 40*d* may each have a corresponding first side wall interior surface 14*a*, second side wall interior surface 14*b*, third side wall interior surface 14*c*, and fourth side wall interior surface 14*d* that cooperate to define a portion of the interior portion 16. The interior portion 16 may be further defined by a first bottom wall interior surface 14*e* of the first bottom wall 42*a*. As illustrated in FIGS. 2A and 2C, the first side wall 40*a*, the second side wall 40*b*, the third side wall 40*c*, and the fourth side wall 40*d* may each have a corresponding first side wall exterior surface 18*a*, second side wall exterior surface 18*b*, third side wall exterior surface 18*c*, and fourth side wall exterior surface 18*d*, respectively, that cooperate to define a portion of the exterior portion 20 that is outside of the interior portion 16.

In further embodiments, the one or more side walls 40 may have any number of side walls 40 to cooperate to form any suitable shape or combination of shapes when viewed normal to the main portion axis 34. For example, the one or more side walls 40 may cooperate to form a circular shape (not shown), a triangular shape (not shown), an oval shape (not shown), or a polygonal shape having five or more side walls 40 (not shown). In addition, the one or more bottom walls 42 may have any suitable shape or combination of shapes, such as a partially spherical shape (not shown) or an undulating, sinusoidal shape (not shown), for example.

The one or more side walls 40 and the one or more bottom walls 42 (and the one or more interior surfaces 24 of the cover portion 22 illustrated in FIG. 7B) may be positioned and dimensioned to at least partially define an interior portion 16 having any suitable volume. For example, the interior portion 16 may define a volume of 25 quarts, 45 quarts, or 65 quarts.

Figure 2E:
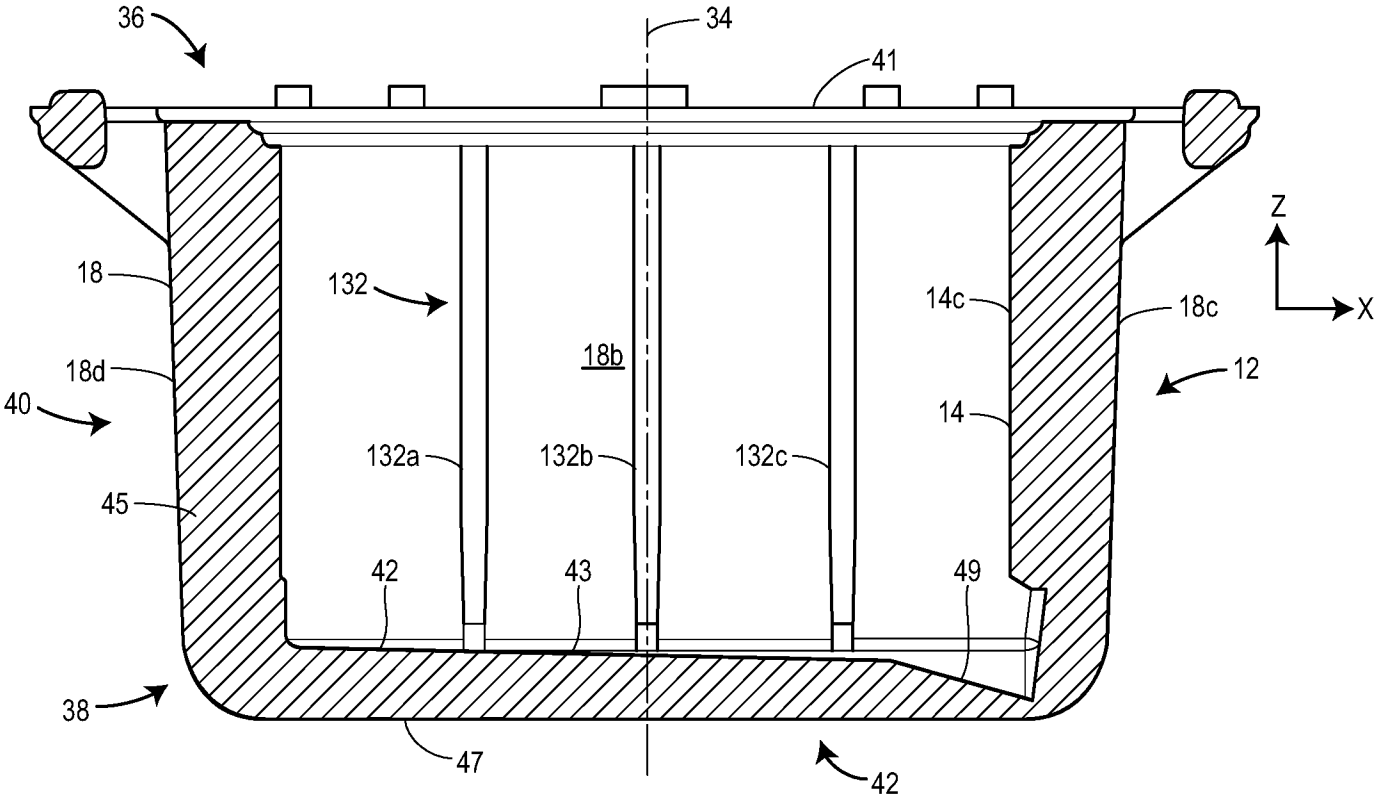
FIG. 2E is a side cross-sectional view of the embodiment of the main portion of FIG. 2A taken along section lines 2E-2E of FIG. 2B.

As illustrated in FIG. 2E, which is a side cross-sectional view of the main portion 12 along section lines 2E-2E of FIG. 2B, the one or more side walls 40 may include one or more insulation materials 45 between the one or more interior surfaces 14 and the one or more exterior surfaces 18. The one or more bottom walls 42 may also include one or more insulation materials 45 between the one or more interior surfaces 43 and one or more exterior surfaces 47 of the bottom walls 42. However, in some embodiments, the one or more side walls 40 may be solid such that no space exists between the one or more interior surfaces 14 and the one or more exterior surfaces 18. Such embodiments of the one or more side walls 40 may result when the main portion 12 (or the one or more side walls 40 of the main portion 12) are made or fabricated by an injection molding process.

The one or more insulation materials 45 may be any suitable insulating material or substance or combination of insulating materials or substances. For example, the one or more insulation materials 45 may include a foam material, an expanding foam material, a fiber material and/or a fluid material. In other examples, the one or more insulation materials 45 may include a vacuum existing or created between the one or more interior surfaces 14 and the one or more exterior surfaces 18 of any or all of the one or more side walls 40 and/or between the one or more interior surfaces 43 and one or more exterior surfaces 47 of the one or more bottom walls 42. The one or more insulation materials 45 may allow the cooler portion 11 to maintain objects disposed within the interior portion 16 (see FIG. 2A) at a temperature that is less than an ambient temperature on the exterior portion 20 of the cooler portion 11. However, the one or more insulation materials 45 may allow the cooler portion 11 may also allow the cooler portion 11 to maintain objects disposed within the interior portion 16 (see FIG. 2A) at a temperature that is greater than an ambient temperature on the exterior portion 20 of the cooler portion 11. In some embodiments, the cooler portion 11 may maintain objects disposed within the interior portion 16 (see FIG. 2A) at a temperature that is greater or less than an ambient temperature on the exterior portion 20 of the cooler portion 11 without the need for one or more insulation materials 45.

Figure 3A:
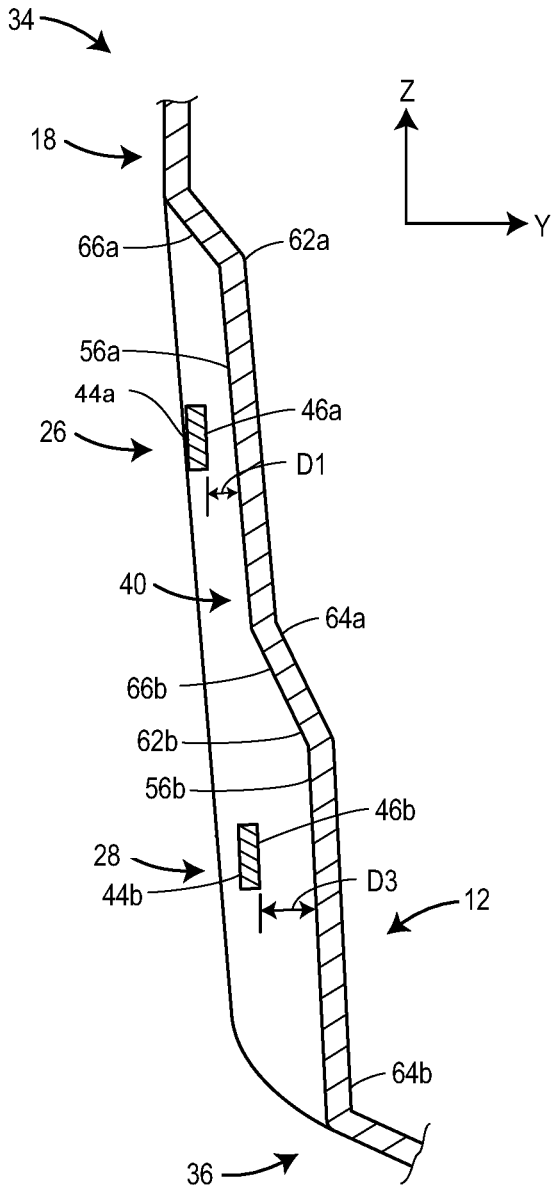
FIG. 3A is a cross-sectional view of an embodiment of a first main portion securement feature taken along line 3A-3A of FIG. 2A.

As illustrated in FIGS. 1 and 3A, the cooler portion 11 may also include a first main portion securement feature 26 disposed at a first location on at least one of the one or more side walls 40 (or one or more exterior surfaces 18) of the main portion 12. The first main portion securement feature 26 may be any feature that allows the first attachment securement feature 32*a* of the first attachment assembly 30*a* to be removably secured to the first main portion securement feature 26 of the cooler portion 11, as illustrated in FIG. 5. The first main portion securement feature 26 may also be any feature that allows the second attachment securement feature 32*b* of the second attachment assembly 30*b* to be removably secured to the first main portion securement feature 26 of the cooler portion 11, as illustrated in FIG. 5.

In some embodiments of the main portion 12, as illustrated in FIG. 2A, the first main portion securement feature 26 may include a first bar portion 44*a* that may be offset from a portion of one or more of the exterior surfaces 18 of the one or more side walls 40. The first bar portion 44*a* may have any suitable shape (or combination of shapes) that allows the first bar portion 44*a* to be releasably engaged by the first attachment securement feature 32*a* of the first attachment assembly 30*a*. As illustrated in FIG. 3A (which illustrates a cross-sectional view of an embodiment of the first main portion securement feature 26 taken along line 3A-3A in FIG. 2A), all or a portion of the first bar portion 44*a* may have a rectangular or substantially rectangular cross-sectional shape. In other embodiments (not shown), the first bar portion 44*a* may have a cross-sectional shape that is at least partially circular. In some embodiments, the first bar portion 44*a* may have a uniform cross-sectional shape across the entire length, or the cross-sectional shape of the first bar portion 44*a* may vary across the length.

The first bar portion 44*a* may be secured to the one or more side walls 40 in any suitable manner. For example, as illustrated in FIG. 2A, the first bar portion 44*a* may be secured between a first lateral ridge 50 and a second lateral ridge 52. Each of the first lateral ridge 50 and the second lateral ridge 52 may be elongated and may extend in a direction along the main portion axis 34 from a first point at or adjacent to the first end 36 of the main portion 12 to a second point at or adjacent to the second end 38 of the main portion 12.

Figure 3B:
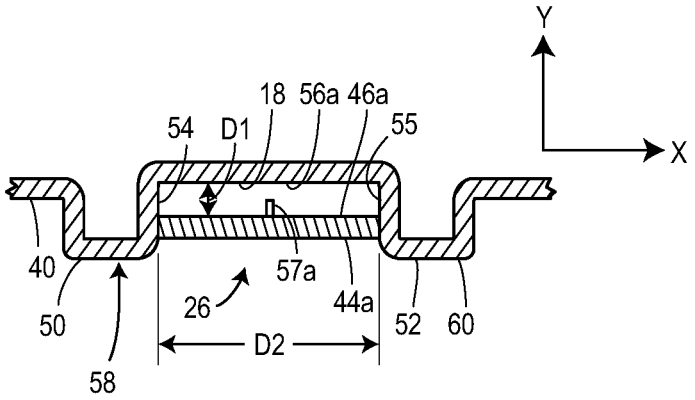
FIG. 3B is a cross-sectional view of a first lateral ridge and a second lateral ridge taken along section line 3B-3B of FIG. 2A.
Figure 3C:
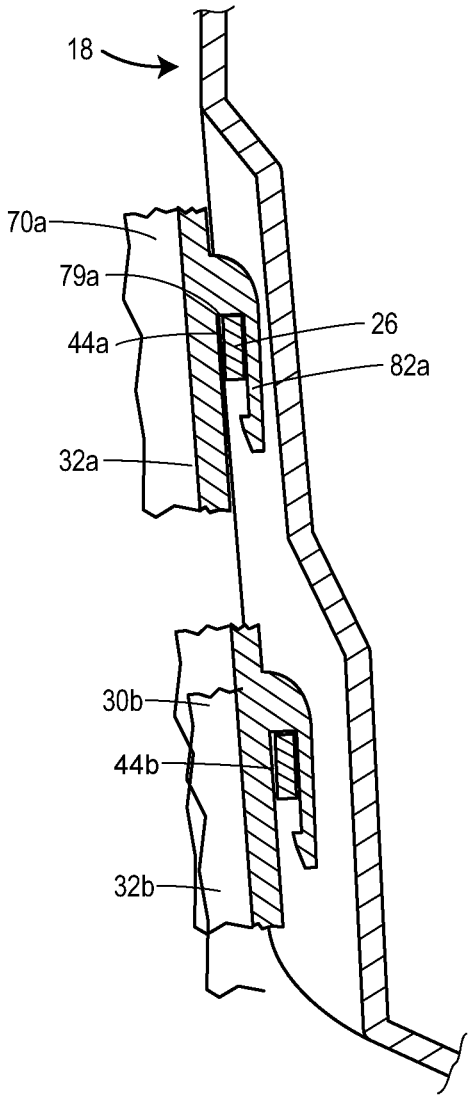
FIG. 3C is a cross-sectional view of the first lateral ridge and the second lateral ridge taken along section line 3A-3A of FIG. 2A with the first attachment securement feature secured to the first main portion securement feature and the second attachment securement feature secured to the second main portion securement feature.

Referring to FIG. 3B, which is a cross-sectional view of the first lateral ridge 50 and the second lateral ridge 52 taken along section line 3B-3B of FIG. 2A, the first lateral ridge 50 and the second lateral ridge 52 may each have a uniform cross-sectional shape between all (or substantially all) or a portion of the distance between the first point and the second point. In the embodiment of FIG. 3B, the first lateral ridge 50 and the second lateral ridge 52 each have a partially rectangular cross-sectional shape that outwardly extends from one or more of the one or side walls 40. More specifically, the first lateral ridge 50 may have an inner wall 54 and the second lateral ridge 52 may have an inner wall 55, and each inner wall 54, 55 may extend away from (e.g., in a direction normal or substantially normal to) a first channel portion 56*a* of the side walls 40 that extends between the first lateral ridge 50 and the second lateral ridge 52. A first end of the first bar portion 44*a* may be secured to a portion of the inner wall 54 of the first lateral ridge 50 and a second end of the first bar portion 44*a* may be secured to a portion of the inner wall 55 of the second lateral ridge 52. In some embodiments, the first channel portion 56*a* of the side walls 40 may be planar and may be separated or offset from the inner surface 46*a* of the first bar portion 44*a* by a first distance D1 that allows the first attachment securement feature 32*a* of the first attachment assembly 30*a* to be secured around the first bar portion 44*a*, as illustrated in FIG. 3C, which is a cross-sectional view of the first lateral ridge 50 and the second lateral ridge 52 taken along section line 3A-3A of FIG. 2A with the first attachment securement feature 32*a* secured to the first main portion securement feature 26. Similarly, the inner wall 54 of the first lateral ridge 50 may be separated from the inner wall 55 of the second lateral ridge 52 by a second distance D2 that allows the first attachment securement feature 32*a* of the first attachment assembly 30*a* to be secured around the first bar portion 44*a*, as illustrated in FIG. 3B. In some embodiments, one or more separation members 57*a* may be disposed along at least a portion of the inner surface 46*a* of the first bar portion 44*a* for embodiments in which the first attachment securement feature 32*a* of the first attachment assembly 30*a* includes two or more cantilevered arms, which will be discussed in more detail below.

The first lateral ridge 50 and the second lateral ridge 52 may each also have a front wall 58, 60 that defines an outward portion of the first lateral ridge 50 and the second lateral ridge 52, and the front walls 58, 60 may be adapted to contact and/or support a portion of the first attachment securement feature 32*a* and/or the first attachment assembly 30*a* when the first attachment securement feature 32*a* is secured to the first main portion securement feature 26. In some embodiments, the front wall 58 of the first lateral ridge 50 may be normal (or substantially normal) to the inner wall 54 of the first lateral ridge 50 and the front wall 60 of the second lateral ridge 52 may be normal (or substantially normal) to the inner wall 55 of the second lateral ridge 52.

The first bar portion 44*a* may be disposed at any suitable location along the Z-axis of the reference coordinate system of FIG. 3A between the first lateral ridge 50 and the second lateral ridge 52. For example, as provided in FIG. 3A, the bar portion may be disposed between the first end 36 of the main portion 12 and the second main portion securement feature 28 (and/or the second end 38 of the main portion 12). The first channel portion 56*a* of the side walls 40 may extend from a first end 62*a* to a second end 64*a*, and the first channel portion 56*a* of the side walls 40 may be parallel or substantially parallel to the Z-axis of the reference coordinate system of FIG. 3A. A first transition surface 66*a* of the side walls 40 may extend between the first end 62*a* of the first channel portion 56*a* and the front wall 58, 60 of one or both of the first lateral ridge 50 and the second lateral ridge 52. The first transition surface 66*a* may be planar and may form an obtuse angle (of between approximately 120° to 160°) with the first channel portion 56*a* when viewed in the cross-sectional view of FIG. 3A. However, the first transition surface 66*a* may have any suitable shape or combination of shapes to provide space to facilitate the attachment of the first attachment securement feature 32*a* of the first attachment assembly 30*a* to the first bar portion 44*a*.

As illustrated in FIGS. 1 and 3A, the cooler portion 11 may also include a second main portion securement feature 28 disposed at a second location on at least one of the one or more side walls 40 (or one or more exterior surfaces 18) of the main portion 12. The second main portion securement feature 28 may be any feature that allows the second attachment securement feature 32*b* of the second attachment assembly 30*b* to be removably secured to the second main portion securement feature 28 of the cooler portion 11, as illustrated in FIG. 5. The second main portion securement feature 28 may also be any feature that allows the first attachment securement feature 32*a* of the first attachment assembly 30*a* to be removably secured to the second main portion securement feature 28 of the cooler portion 11, as illustrated in FIG. 5.

In some embodiments, as illustrated in FIG. 2A, the second main portion securement feature 28 may include a second bar portion 44*b* that may be offset from a portion of one or more of the exterior surfaces 18 of the one or more side walls 40. The second bar portion 44*b* may have any suitable shape (or combination of shapes) that allows the second bar portion 44*b* to be releasably engaged by the second attachment securement feature 32*b* of the second attachment assembly 30*b*. In some embodiments, the second bar portion 44*b* of the second main portion securement feature 28 may be identical or substantially identical to the first bar portion 44*a* of the first main portion securement feature 26. That is, as illustrated in FIG. 3A, all or a portion of the second bar portion 44*b* may have a rectangular or substantially rectangular cross-sectional shape. In other embodiments (not shown), the second bar portion 44*b* may have a cross-sectional shape that is at least partially circular. In some embodiments, the second bar portion 44*b* may have a uniform cross-sectional shape across the entire length, or the cross-sectional shape of the second bar portion 44*b* may vary across the length.

Figure 3D:
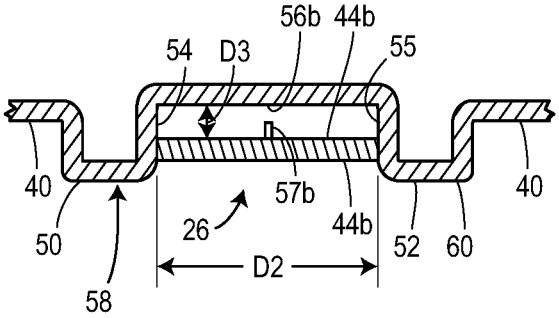
FIG. 3D is a cross-sectional view of the first lateral ridge and the second lateral ridge taken along section line 3D-3D of FIG. 2A.

As illustrated in FIG. 3A, second bar portion 44*b* may be offset from a second channel portion 56*b* of the side walls 40. Referring to FIG. 3D, which is a cross-sectional view of the first lateral ridge 50 and the second lateral ridge 52 taken along section line 3D-3D of FIG. 2A, the second channel portion 56*b* may extend between the inner wall 54 of the first lateral ridge 50 and the inner wall 55 of the second lateral ridge 52. In some embodiments, the second channel portion 56*b* may be planar or substantially planar and may be separated or offset from an inner surface 46*b* of the second bar portion 44*b* by a third distance D3 that allows the second attachment securement feature 32*b* of the second attachment assembly 30*b* to be secured around the second bar portion 44*b*, as illustrated in FIG. 3C. In some embodiments, the third distance D3 may be equal to (or approximately equal to) the first distance D1. In some embodiments, all or part of the second channel portion 56*b* may be non-planar.

The second bar portion 44*b* may be secured to the one or more side walls 40 in any suitable manner. For example, as illustrated in FIG. 2A, the second bar portion 44*b* may be secured between the first lateral ridge 50 and the second lateral ridge 52. As illustrated in FIG. 3D, a first end of the second bar portion 44*b* may be secured to a portion of the inner wall 54 of the first lateral ridge 50 and a second end of the second bar portion 44*b* may be secured to a portion of the inner wall 55 of the second lateral ridge 52.

The inner wall 54 of the first lateral ridge 50 may be separated from the inner wall 55 of the second lateral ridge 52 by any suitable distance, such as the second distance D2 (or at least the second distance D2) that allows the second attachment securement feature 32*b* of the second attachment assembly 30*b* to be secured around the second bar portion 44*b*, as illustrated in FIG. 3C. As illustrated in FIG. 3D, one or more separation members 57*b* may be disposed along at least a portion of the inner surface 46*b* of the second bar portion 44*b* for embodiments in which the second attachment securement feature 32*b* of the second attachment assembly 30*b* includes two or more cantilevered arms, which will be discussed in more detail below. The front wall 58, 60 of each of the first lateral ridge 50 and the second lateral ridge 52 may be adapted to contact and/or support a portion of the second attachment securement feature 32*b* and/or the second attachment assembly 30*b* when the second attachment securement feature 32*b* is secured to the second main portion securement feature 28.

The second bar portion 44*b* may be disposed at any suitable location along the Z-axis of the reference coordinate system of FIG. 3A between the first lateral ridge 50 and the second lateral ridge 52. For example, as provided in FIG. 3A, the second bar portion 44*b* may be disposed between the second end 38 of the main portion 12 and the first main portion securement feature 26 (and/or the first end 36 of the main portion 12).

The second channel portion 56*b* of the side walls 40 may extend from a first end 62*b* to a second end 64*b*, and the second channel portion 56*b* may be parallel or substantially parallel to the Z-axis of the reference coordinate system of FIG. 3A. The second end 64*b* of the second channel portion 56*b* may be at or adjacent to the second end 38 of the main portion 12. A second transition surface 66*b* of the side walls 40 may extend between the first end 62*b* of the second channel portion 56*b* and the second end 64*a* of the first channel portion 56*a*. The second transition surface 66*b* may be planar and may form an obtuse angle (of between approximately 120° to 160°) with the second channel portion 56*b* when viewed in the cross-sectional view of FIG. 3A. However, the second transition surface 66*b* may have any suitable shape or combination of shapes to provide space to facilitate the attachment of the second attachment securement feature 32*b* of the second attachment assembly 30*b* to the second bar portion 44*b*. In some embodiments (not shown), the first channel portion 56*a* and the second channel portion 56*b* may be coplanar and no second transition surface 66*b* may be present.

Any number of additional main portion securement features may be disposed on the main portion 12. In some embodiments, a third bar portion (not shown) and further bar portions (not shown) may be disposed between the first lateral ridge 50 and the second lateral ridge 52, and the third bar portion (and any further bar portions) may be identical to the first bar portion 44*a* and/or the second bar portion 44*b*. However, any number of main portion securement features (e.g., the first main portion securement feature 26 and/or the second main portion securement feature 28) may be disposed at any location on the main portion 12, and one or more main portion securement features may be disposed on the first side wall 40*a*, the second side wall 40*b*, the third side wall 40*c*, and/or the fourth side wall 40*d* of the main portion 12.

It should be understood that the improvements disclosed herein are not to be limited to the particular securement feature designs illustrated in FIGS. 3A-3D. The improvements disclosed herein may be implemented using one or more securement features having other designs, including one or more other types of removable attachment or engagement features. These alternate securement features may include one or more of a slot, a post, a cap, a lip, a groove, a shoulder, a mushroom head, a catch, a snap, a quick release, a bayonet mount, a hook and loop fastener, and/or a channel. These alternate securement features may utilize one or more of a snap fit, a friction fit, an interference fit, and/or may utilize gravity for engagement.

In some embodiments, more than one first lateral ridge 50 and second lateral ridge 52 may be disposed on the main portion 12. For example, as illustrated in FIG. 2A, two sets of first lateral ridges 50 and second lateral ridges 52 may be disposed on the first side wall 40*a* and as illustrated in FIG. 2C, two sets of first lateral ridges 50 and second lateral ridges 52 may be disposed on the second side wall 40*b*. In some embodiments (not shown), one or more sets of first lateral ridges 50 and second lateral ridges 52 may be disposed on the third side wall 40*c* and/or the fourth side wall 40*c*. Two or more bar portions (not shown) may extend between any or all of the sets of first lateral ridges 50 and second lateral ridges 52. Any number of bar portions may be disposed at any location on the main portion 12, and one or more bar portions may be disposed on the first side wall 40*a*, the second side wall 40*b*, the third side wall 40*c*, and/or the fourth side wall 40*d* of the main portion 12. The cover portion 22 may also include one or more first main portion securement feature 26 and/or second main portion securement feature 28. For example, the cover portion 22 may include one or more sets of first lateral ridges 50 and second lateral ridges 52 (not shown) and two or more bar portions (not shown) may extend between any or all of the sets of first lateral ridges 50 and second lateral ridges 52 on the cover portion 22.

As illustrated in FIG. 1, the cooler assembly 10 may further include a first attachment assembly 30*a* that may be adapted to be removably secured to a portion of the cooler portion 11, such as the first main portion securement feature 26 and/or the second main portion securement feature 28. The first attachment assembly 30*a* may include an accessory portion 68*a* that may be removably secured to the cooler portion 11. FIG. 4A provides an example of such an accessory portion 68*a*. Specifically, FIG. 4A provides a perspective view of a first attachment assembly 30*a* in which the accessory portion 68*a* is a container 69*a* that can be opened and closed. The container 69*a* may be adapted to contain, store, and/or transport one or more items or materials that a user may wish to transport with the cooler portion 11 but may not want to contain, store, and/or transport in the interior portion 16 of the cooler portion 11. For example, the container 69*a* may contain metal objects that may corrode if exposed to a liquid that may be disposed within the interior portion 16 of the cooler portion 11. The container 69*a* may be sealed (e.g., by a gasket) such that liquid or debris may not enter into an interior portion of the container 69*a*. In other embodiments, the container 69*a* may be sealed such that the container is waterproof and may prevent liquid from entering into the interior portion of the container 69*a* when the container 69*a* is submerged in the liquid. The container 69*a* may be secured by a closing mechanism such that the container 69*a* does not accidentally or unintentionally open when being transported with the cooler portion 11. In addition, the container 69*a* may be secured by a locking mechanism such that the user may prevent an unauthorized user from opening the container 69*a*, and such a container 69*a* may be used to store or contain valuables, such as a mobile phone or jewelry, for example.

The first attachment assembly 30*a* may include a first attachment securement feature 32*a* that may be coupled to the accessory portion 68*a*. In some embodiments, the first attachment securement feature 32*a* may be removably coupled to the accessory portion 68*a*. For example, as illustrated in FIG. 4A, the first attachment securement feature 32*a* may be disposed on a clip portion 70*a*, and the clip portion 70*a* may be removably secured to the accessory portion 68*a*.

Figure 4B:
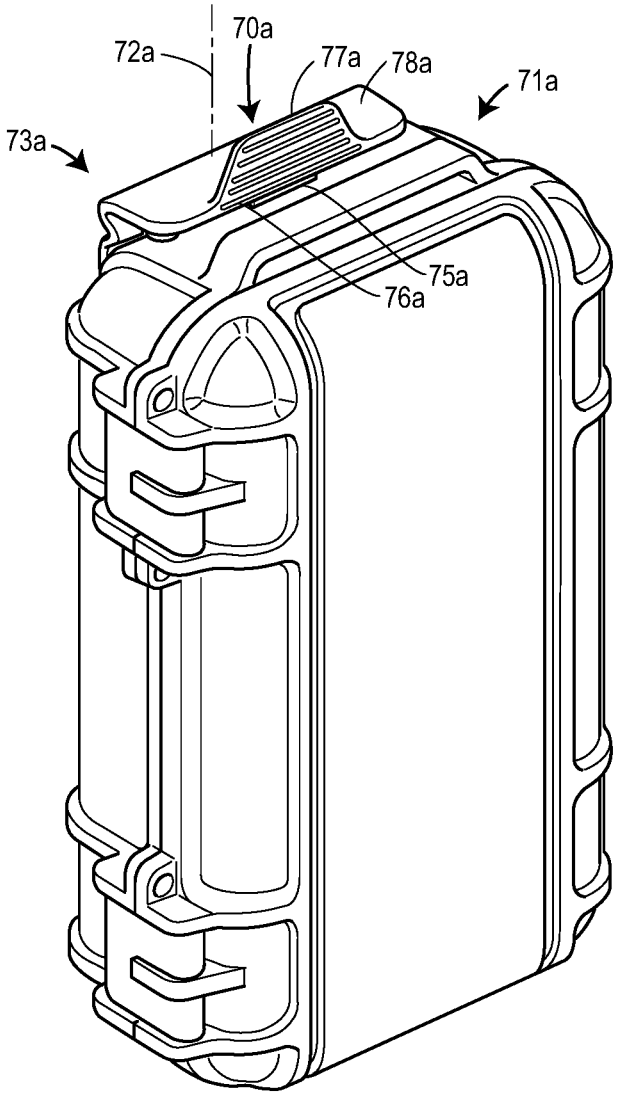
FIG. 4B is a top perspective view of the embodiment of the first attachment assembly of FIG. 4A.

The clip portion 70*a* may be removably secured to the accessory portion 68*a* in any suitable fashion. For example, as illustrated in FIG. 4A, the clip portion 70*a* may extend along a clip axis 72*a* from a first end 73*a* to a second end 74*a*. A clip body 79*a* may extend from the first end 73*a* to the second end 74*a*, and a first clip arm 78*a* may extend away from the clip body 79*a* at or adjacent to the first end 73*a*. As shown in FIG. 4B, which illustrates a top perspective view of the first attachment assembly 30*a* of FIG. 4A, the first clip arm 78*a* of the clip portion 70*a* may include a lip 75*a* disposed at or adjacent to an end portion of the first clip arm 78*a*, and the lip 75*a* may removably engage a slot 76*a* formed in or on a first end 71*a* of the accessory portion 68*a* to secure the clip portion 70*a* to the accessory portion 68*a*. Because the first clip arm 78*a* is cantilevered from the clip body 79*a*, a spring force maintains the lip 75*a* within the slot 76*a* during normal use. To remove the lip 75*a* from the slot 76*a*, a grip portion 77*a* disposed at or adjacent to the end portion of the first clip arm 78*a* may be displaced away from the slot 76*a*, and the first clip arm 78*a* may deflect away from the slot 76*a*, thereby freeing the lip 75*a*.

As illustrated in FIG. 4A, a second clip arm 80*a* may extend away from the clip body 79*a* at or adjacent to the second end 74*a*, and the second clip arm 80*a* may be removably secured to the accessory portion 68*a* in any suitable manner. For example, the second clip arm 80*a* of the clip portion 70*a* may include a lip (not shown) disposed at or adjacent to an end portion of the second clip arm 80*a*, and the lip may removably engage a slot (not shown) formed in or on a second end 81*a* of the accessory portion 68*a* to secure the clip portion 70*a* to the accessory portion 68*a*. To attach the clip portion 70*a* to the accessory portion 68*a*, the lip on the second clip arm 80*a* may be first secured to the second end 81*a* of the accessory portion 68*a* and the lip 75*a* of the first clip arm 78*a* may then be positioned in the slot 76*a* using the grip portion 77*a*.

Figure 4C:
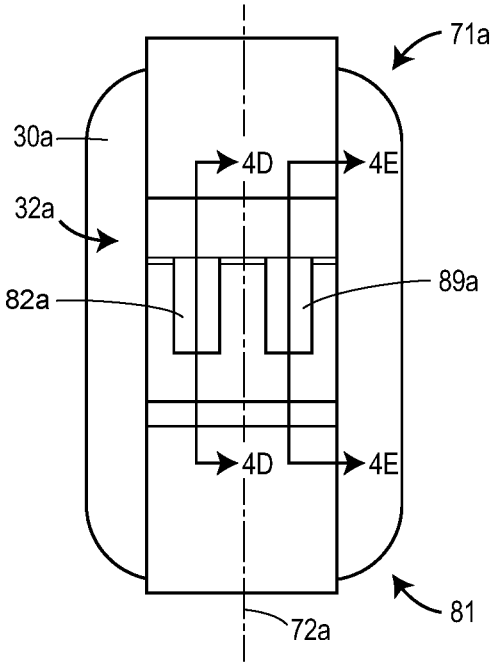
FIG. 4C is a rear view of the embodiment of the first attachment assembly of FIG. 4A.
Figure 4D:
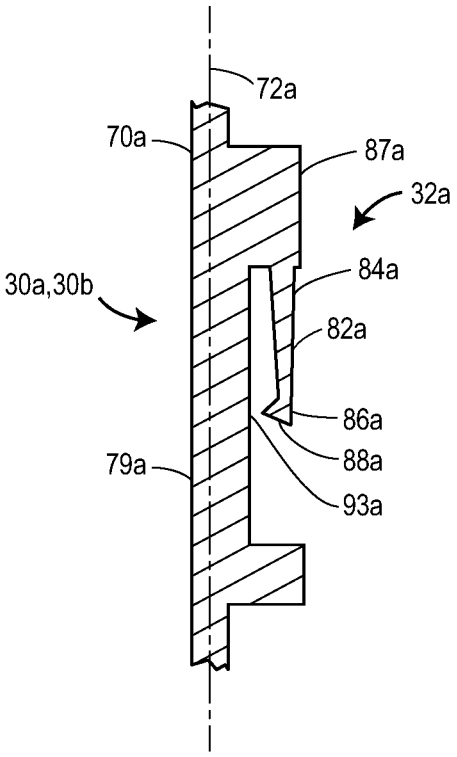
FIG. 4D is a partial sectional side view of an embodiment of a clip portion of an embodiment of the first attachment assembly taken along section line 4D-4D of FIG. 4C.

The first attachment securement feature 32*a* may be coupled to or formed on the clip portion 70*a*. Referring to FIG. 4A, the first attachment securement feature 32*a* may include at least one retaining arm (such as a first retaining arm 82*a*) adapted to releasably engage the first bar portion 44*a* and/or the second bar portion 44*b*. As illustrated in FIG. 4C, which is a rear view of the first attachment assembly 30*a*, the first retaining arm 82*a* may extend from a first end 84*a* to a second end 86*a* in a direction parallel to the clip axis 72*a*. As illustrated in FIG. 4D, which is a partial sectional side view of the clip portion 70*a* taken along section line 4D-4D of FIG. 4C, the first retaining arm 82*a* may be cantilevered from an arm base 87*a*. That is, the first end 84*a* of the first retaining arm 82*a* may be fixed to and extend from a first portion of the arm base 87*a*, and the second end 86*a* may be a free end that may displace in a direction normal to the clip axis 72*a*. A detent 88*a* may be disposed at or adjacent to the second end 86*a* of the first retaining arm 82*a* and may inwardly extend form the first retaining arm 82*a* towards the clip body 79*a*.

Figure 4E:
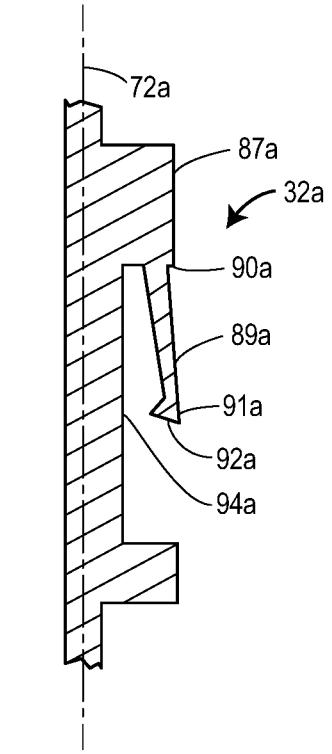
FIG. 4E is a partial sectional side view of an embodiment of a clip portion of an embodiment of the first attachment assembly taken along section line 4E-4E of FIG. 4C.

As illustrated in FIG. 4C, the first attachment securement feature 32*a* may also include a second retaining arm 89*a* that may be identical or substantially identical to the first retaining arm 82*a*. That is, the second retaining arm 89*a* may extend from a first end 90*a* to a second end 91*a* in a direction parallel to the clip axis 72*a*. As illustrated in FIG. 4E, which is a partial sectional side view of the clip portion 70*a* taken along section line 4E-4E of FIG. 4C, the second retaining arm 89*a* may be cantilevered from the arm base 87*a*. That is, the first end 90*a* of the second retaining arm 89*a* may be fixed to and extend from a second portion of the arm base 87*a*, and the second end 91*a* may be a free end that may displace in a direction normal to the clip axis 72*a*. A detent 92*a* may be disposed at or adjacent to the second end 91*a* of the second retaining arm 89*a* and may inwardly extend form the second retaining arm 89*a* towards the clip body 79*a*. Any number of additional retaining arms is also contemplated, and any of the additional retaining arms may be identical to the first retaining arm 82*a* and may extend from the arm base 87*a*.

As illustrated in FIG. 1, the cooler assembly 10 may further include the second attachment assembly 30*b* that may be adapted to be removably secured to a portion of the cooler portion 11, such as the second main portion securement feature 28 and/or the first main portion securement feature 26 (or any additional main portion securement features). The second attachment assembly 30*b* may include an accessory portion 68*b* that may be removably secured to the cooler portion 11, such as a container 69*b* that can be opened and closed as pictured FIG. 6. The accessory portion 68*b* of the second attachment assembly 30*b* may be similar or identical to the accessory portion 68*a* of the first attachment assembly 30*a*. However, the accessory portion 68*b* of the second attachment assembly 30*b* may be different in size and/or function to the accessory portion 68*a* of the first attachment assembly 30*a*.

The second attachment assembly 30*b* may include a second attachment securement feature 32*b* that may be coupled to the accessory portion 68*b*, and the second attachment securement feature 32*b* may be identical or substantially identical to the first attachment securement feature 32*a*, as illustrated in FIG. 6, which is a rear perspective view of the second attachment assembly 30*b*. Therefore, elements having reference numbers that end with a "b" in reference to the second attachment securement feature 32*b* correspond to (and are identical to) elements having reference numbers that end with an "a" in FIGS. 4A to 4E (which illustrates the first attachment assembly 30*a* having the first attachment securement feature 32*a*).

Similar to the first attachment assembly 30*a*, the second attachment assembly 30*b* may include a clip portion 70*b*. The clip portion 70*b* of the second attachment assembly 30*b* may have any suitable size or shape and may be secured to the accessory portion 68*b* of the second attachment assembly 30*b* in any suitable manner. For example, the clip portion 70*b* may extend along a clip axis 72*b* from a first end 73*b* to a second end 74*b*. A clip body 79*b* may extend from the first end 73*b* to the second end 74*b*, and a first clip arm 78*b* and a second clip arm 80*b* may be removably secured to the accessory portion 68*b* in the manner previously described regarding the first clip arm 78*a* and the second clip arm 80*a* of the clip portion 70*a* of the first attachment assembly 30*a*. The second attachment securement feature 32*b* may be coupled to or formed on the clip portion 70*b*, and the second attachment securement feature 32*b* may include at least one retaining arm (such as a first retaining arm 82*b*) adapted to releasably engage the first bar portion 44*a* and/or the second bar portion 44*b*. The first retaining arm 82*b* may extend from a first portion of an arm base 87*b*, and a second retaining arm 89*b* may extend from a second portion of an arm base 87*b*. The first retaining arm 82*b* and the second retaining arm 89*b* of the second attachment securement feature 32*b* may be identical in shape and size to the first retaining arm 82*a* and the second retaining arm 89*a* of the first attachment securement feature 32*a*.

In use, a user may wish to attach the first attachment assembly 30*a* to the cooler portion 11 to allow the first attachment assembly 30*a* to be stored on and/or transported with the cooler portion 11. For example, a user may wish to store an article in the container 69*a* of the first attachment assembly 30*a* for use during an activity or at an event in which the cooler assembly 10 is used. To attach the first attachment assembly 30*a* to the cooler portion 11, the first attachment assembly 30*a* may be positioned such that the clip axis 72*a* is generally aligned with the main portion axis 34 of the cooler portion 11 (see FIG. 2A) and/or such that the second end 86*a* of the first retaining arm 82*a* and the second end 91*a* of the second retaining arm 89*a* are each adjacent to a top portion of the first bar portion 44*a*. In some embodiments, the first retaining arm 82*a* may be positioned on a first side of the separation member 57*a* (see FIG. 3B) of the first bar portion 44*a* and the second retaining arm 89*a* may be positioned on a second side of the separation member 57*a* of the first bar portion 44*a*.

The user may then downwardly displace the first attachment assembly 30*a* along the clip axis 72*a* towards the second end 38 of the main portion 12 of the cooler assembly 11 (see FIG. 2A). As illustrated in FIG. 4D, a distance between an apex of the detent 88*a* of the first retaining arm 82*a* and an adjacent portion 93*a* of the clip body 79*a* may be less than a width of the first bar portion 44*a* (e.g., as illustrated in FIG. 3A, the dimension of the bar portion 44*a* along the Y-axis of the reference coordinate system). Similarly, as illustrated in FIG. 4E, a distance between an apex of the detent 92*a* of the second retaining arm 89*a* and an adjacent portion 94*a* of the clip body 79*a* is less than the width of the first bar portion 44*a*. Accordingly, as the first attachment assembly 30*a* is downwardly displaced, the apex of the detent 88*a* of the first retaining arm 82*a* (illustrated in FIG. 4D) and the apex of the detent 92*a* of the second retaining arm 89*a* (illustrated in FIG. 4E) each contacts a corresponding portion of the first bar portion 44*a*. This contact displaces the second end 86*a* of the first retaining arm 82*a* (illustrated in FIG. 4D) away from the first bar portion 44*a* and towards the first channel portion 56*a* of the side wall 40 (illustrated in FIG. 3A) and also displaces the second end 91*a* of the second retaining arm 89*a* (illustrated in FIG. 4E) away from the first bar portion 44*a* and towards the first channel portion 56*a* of the side wall 40 (illustrated in FIG. 3A). In some embodiments, the distance the second end 86*a* of the first retaining arm 82*a* displaces away from the first bar portion 44*a* and towards the first channel portion 56*a* of the side wall 40 may be less than the first distance D1 (illustrated in FIG. 3A) and the distance the second end 91*a* of the second retaining arm 89*a* displaces away from the first bar portion 44*a* and towards the first channel portion 56*a* of the side wall 40 may be less than the first distance D1.

As the first attachment assembly 30*a* continues to be downwardly displaced, the apex of the detent 88*a* of the first retaining arm 82*a* and the apex of the detent 92*a* of the second retaining arm 89*a* each moves past a bottom portion of the first bar portion 44*a* and a bottom portion of the arm base 87*a* (adjacent to the first end 84*a* of the first retaining arm 82*a* and the first end 90*a* of the second retaining arm

89*a*) may come into contact with or be positioned adjacent to the top portion of the first bar portion 44*a*, as illustrated in FIG. 3C. Because the first bar portion 44*a* is disposed between the bottom portion of the arm base 87*a* and the apex of the detent 88*a* of the first retaining arm 82*a* and the apex of the detent 92*a* of the second retaining arm 89*a*, the first attachment assembly 30*a* is secured to the first bar portion 44*a* and cannot be removed unless the first attachment assembly 30*a* is upwardly displaced with enough force to outwardly displace the apex of the detent 88*a* of the first retaining arm 82*a* and the apex of the detent 92*a* of the second retaining arm 89*a* as each moves past the bottom portion of the first bar portion 44*a*. The detent 88*a* of the first retaining arm 82*a* and the detent 92*a* of the second retaining arm 89*a* may each be sized and dimensioned to achieve a desirable cantilever spring retaining force when the second end 86*a* of the first retaining arm 82*a* and the second end 91*a* of the second retaining arm 89*a* move past and/or contact top portion and/or the bottom portion of the first bar portion 44*a*. Accordingly, the first attachment assembly 30*a* may be removably secured to the cooler portion 11 in a manner that allows for easy attachment and detachment but also protects against accidental detachment during transport.

As previously explained, the first attachment assembly 30*a* may be removably secured to the first main portion securement feature 26 or the second main portion securement feature 28 (and/or any further securement feature on the main portion 12 and/or the cover portion 22). Accordingly, the first attachment assembly 30*a* may also be removably secured to the second bar portion 44*b* illustrated in FIG. 3A in a manner identical to the manner in which the first attachment assembly 30*a* is removably secured to the first bar portion 44*a*. In addition, the first attachment assembly 30*a* may be removably secured to any further bar portion of any further main portion securement features disposed on the cooler portion 11. Consequently, the first attachment assembly 30*a* (and the second attachment assembly 30*b*) is a modular accessory that can be conveniently attached to any or several locations on the cooler portion 11 for convenience to the user and to create a personalized arrangement of accessories on the cooler portion 11.

A user may also wish to attach the second attachment assembly 30*b* to the cooler portion 11 to allow the second attachment assembly 30*b* to be stored on and/or transported with the cooler portion 11. In some embodiments, the second attachment assembly 30*b* may be secured to the second main portion securement feature 28 (e.g., the second bar portion 44*b*) in the same manner in which the first attachment assembly 30*a* is secured to the first main portion securement feature 26 (e.g., the first bar portion 44*a*). That is, the second attachment assembly 30*b* may be positioned such that the clip axis 72*b* is generally aligned with the main portion axis 34 of the main portion 12 (see FIG. 2A) and/or such that the second end 86*b* of the first retaining arm 82*b* and the second end 91*b* of the second retaining arm 89*b* are each adjacent to a top portion of the second bar portion 44*b*.

The user may then downwardly displace the second attachment assembly 30*b* along the clip axis 72*b* towards the second end 38 of the main portion 12 of the cooler assembly 11 (see FIG. 2A) until the apex of the detent 88*b* of the first retaining arm 82*b* (illustrated in FIG. 4D) and the apex of the detent 92*b* of the second retaining arm 89*b* (illustrated in FIG. 4E) each locks around the second bar portion 44*b*, thereby securing the second attachment assembly 30*b* to the second bar portion 44*b*.

This contact displaces the second end 86*b* of the first retaining arm 82*b* (illustrated in FIG. 4D) away from the second bar portion 44*b* and towards the second channel portion 56*b* of the side wall 40 (illustrated in FIG. 3A) and also displaces the second end 91*b* of the second retaining arm 89*b* (illustrated in FIG. 4E) away from the second bar portion 44*a* and towards the first channel portion 56*a* of the side wall 40 (illustrated in FIG. 3A). In some embodiments, the distance the second end 86*a* of the first retaining arm 82*a* displaces away from the first bar portion 44*a* and towards the first channel portion 56*a* of the side wall 40 may be less than the first distance D1 (illustrated in FIG. 3A) and the distance the second end 91*a* of the second retaining arm 89*a* displaces away from the first bar portion 44*a* and towards the first channel portion 56*a* of the side wall 40 may be less than the first distance D1.

In other examples, one or more items may removably attach to one or more of the securement features using other methods. In one example, an item which attaches to one or more of the securement features 28 may extend, at least partially, into the first channel portion 56*a* and extend over the first bar portion 44*a*, at least partially. The item may exert a spring force to removably engage with the first bar portion 44*a* without necessarily including an arm, such as the retaining arm 89, to extend behind or to another side of the first bar portion 44*a*. In this way, an object may removably attach to the cooler assembly 10 by exerting a spring force on opposing sides of the cooler assembly 10 to removably attach the item by snapping over or "cupping over" two or more of the bar portions without necessarily including retaining arms which extend around back sides of bar portions.

As previously explained, the first attachment assembly 30*a* and the second attachment assembly 30*b* may each include an accessory portion 68*a*, 68*b*. While the accessory portions 68*a*, 68*b* have been illustrated as individual containers 69*a*, 69*b* that can open and close to store one or more articles or objects, the accessory portion 68*a* of the first attachment assembly 30*a* and the accessory portion 68*b* of the second attachment assembly 30*b* may be any item or feature that a user would desire to attach to the cooler portion 12. For example, the accessory portion 68*a* of the first attachment assembly 30*a* and/or the accessory portion 68*b* of the second attachment assembly 30*b* may be a cup holder, a condiment holder, or a holder for one or more utensils. In other embodiments, the accessory portion 68*a* of the first attachment assembly 30*a* and/or the accessory portion 68*b* of the second attachment assembly 30*b* may be an electronic device or one or more accessories for an electronic device, such as a radio, a holder for a radio, a battery, a light, a cellphone or tablet, or a holder or case for a cellphone or tablet, for example.

In addition, the accessory portion 68*a* of the first attachment assembly 30*a* and/or the accessory portion 68*b* of the second attachment assembly 30*b* may be a fishing rod holder or fishing rod securing device that allows a user to secure a fishing rod to the cooler portion 11. The accessory portion 68*a* of the first attachment assembly 30*a* and/or the accessory portion 68*b* of the second attachment assembly 30*b* may also be an umbrella holder or umbrella securing device that allows a user to secure an umbrella to the cooler portion 11 in either (or both) of a stored closed position or an open position. Further, the accessory portion 68*a* may include an interface or adapter which interchangeably receives one or more of a variety of holders or adapters including, but not limited to a cup holder, a rod holder, an umbrella holder, and/or a speaker holder. In this way, a single accessory portion 68*a* may be used with a variety of different types of holders or adapters.

In other embodiments, the accessory portion 68*a* of the first attachment assembly 30*a* and the accessory portion 68*b* of the second attachment assembly 30*b* may be the same accessory. That is, the first attachment assembly 30*a* and the second attachment assembly 30*b* may each include a common accessory portion 68*a* (not shown), and the common accessory portion 68*a* may include a first attachment securement feature 32*a* and a second attachment securement feature 32*b* that may cooperate to secure the common accessory portion 68*a* to the cooler portion 11. For example, the common accessory portion 68*a* may be a single tray, radio, or speaker that includes both a first attachment securement feature 32*a* (that is removably secured to the first main portion securement feature 26) and second attachment securement feature 32*b* (that is removably secured to the second main portion securement feature 28 or a further first main portion securement feature 26 or other main portion securement feature). In other embodiments, the common accessory portion 68*a* may be a single fishing rod holder or a single umbrella holder that includes both a first attachment securement feature 32*a* (that is removably secured to the first main portion securement feature 26) and second attachment securement feature 32*b* (that is removably secured to the second main portion securement feature 28 or a further first main portion securement feature 26 or other main portion securement feature) to provide additional rotational or lateral support for the stored fishing rod or umbrella, respectively.

In some embodiments, the accessory portion 68*a* of the first attachment assembly 30*a* and/or the accessory portion 68*b* of the second attachment assembly 30*b* (and any other accessory portion of any further attachment assembly) may be a wheel, a roller, or a set of wheels, etc. (not shown), that allow the cooler portion 11 to be more easily moved by a user. In addition, the accessory portion 68*a* of the first attachment assembly 30*a* and/or the accessory portion 68*b* of the second attachment assembly 30*b* (and any other accessory portion of any further attachment assembly) may be a cart or trolley (not shown). More particularly, the first attachment securement feature 32*a* and/or the second attachment securement feature 32*b* (and any further attachment securement feature) may be secured to a securement feature identical to the first main portion securement feature 26 of the cooler portion 11 to facilitate the transportation of the cooler portion 11. In other embodiments, the accessory portion 68*a* of the first attachment assembly 30*a* and/or the accessory portion 68*b* of the second attachment assembly 30*b* (and any other accessory portion of any further attachment assembly) may be a deck or other permanent or semi-permanent surface (not shown). In such embodiments, the first attachment securement feature 32*a* and/or the second attachment securement feature 32*b* (and any further attachment securement feature) may be secured to a securement feature identical to the first main portion securement feature 26 disposed on the cooler portion 11 to secure the cooler portion 11 to the deck or surface.

Figure 7C:
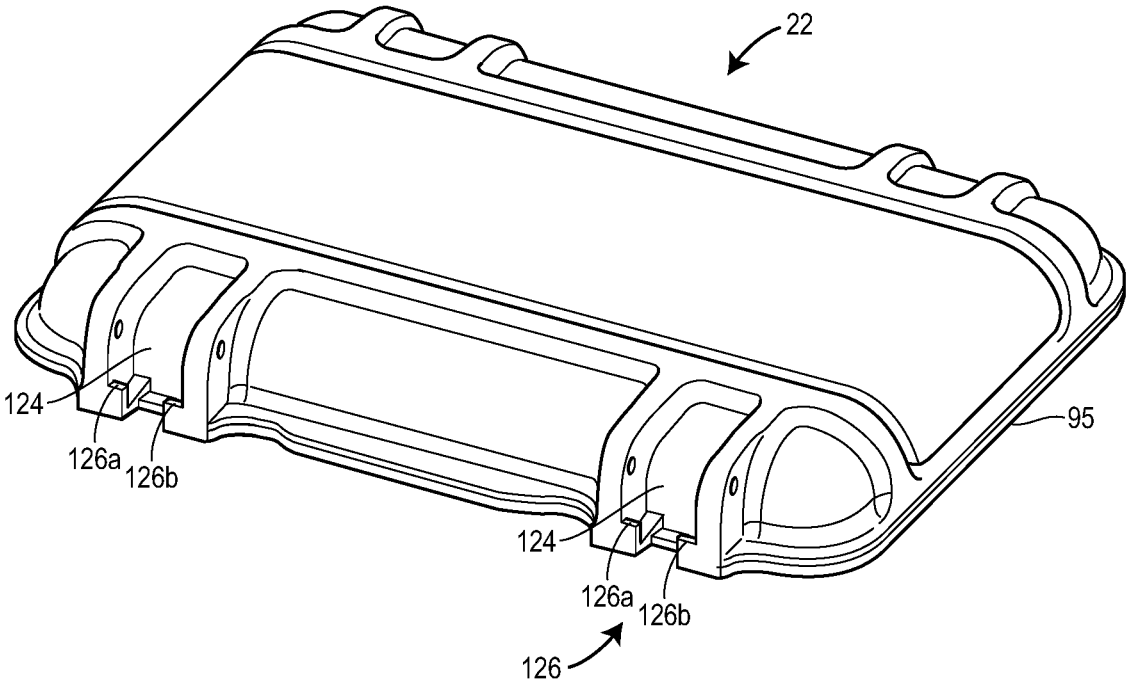
FIG. 7C is a perspective view of the embodiment of the cover portion 22 of FIG. 7A.

As previously discussed, the cooler portion 11 may additionally include a cover portion 22 at least one of pivotably coupled to or removably secured to the main portion 12. As illustrated in the FIG. 7A, which provides a top view of the cover portion 22, (and FIG. 7C, which provides a perspective view of the cover portion 22) the cover portion 22 may be defined by a perimeter edge 95 that may be similar or identical in shape to the open first end 36 of the main portion 12 such that when the cover portion 22 is coupled to or removably secured to the main portion 12, the cover portion 22 surrounds and covers the entire open first end 36 of the main portion 12. In embodiments in which the main portion 12 may include four side walls 40 that may cooperate to form a rectangular (or generally rectangular) shape when viewed along the main portion axis 34 (as illustrated in FIG. 2A), the cover portion 22 may include four perimeter edges 95 that may cooperate to form a rectangular (or generally rectangular) shape when viewed along the main portion axis 34 (as illustrated in FIG. 7A), and the four perimeter edges 95 may cooperate to form the same shape as or align with (when the cover portion 22 is in a closed position, as illustrated in FIG. 1) one or more perimeter edges 47 that define the outer perimeter of the upper surface 41 (as illustrated in FIG. 2B). More specifically, with reference to FIG. 7A, the cover portion 22 may include a first perimeter edge 95*a* that extends in a direction parallel to the X-axis of the reference coordinate system of FIG. 7A, and the first perimeter edge 95*a* may correspond to or align with the first side wall 40*a* of the main portion 12 when the cover portion 22 is in a closed position (as illustrated in FIG. 1). The cover portion 22 may also include a second perimeter edge 95*b* parallel to and offset from (along the Y-axis of the reference coordinate system of FIG. 7A) the first perimeter edge 95*a* that may correspond to or align with the second side wall 40*b* of the main portion 12 when the cover portion 22 is in a closed position of FIG. 1. The cover portion 22 may additionally include a third perimeter edge 95*c* and a fourth perimeter edge 95*d* that each extend between and normal to the first perimeter edge 95*a* and the second perimeter edge 95*b*, and the third perimeter edge 95*c* and the fourth perimeter edge 95*d* may correspond to or align with the third side wall 40*c* and the fourth side wall 40*d*, respectively, of the main portion 12 when the cover portion 22 is in the closed position of FIG. 1.

As previously discussed, one or more interior surfaces 24 of the cover portion 22 (shown in the bottom view of the cover portion 22 in FIG. 7B) may cooperate to at least partially further define the interior portion 16 of the cooler portion 11 when the cover portion 22 is in the closed position of FIG. 1. In addition, as illustrated in FIG. 7A, one or more exterior surfaces 96 of the cover portion 22 may cooperate to at least partially define the exterior portion 20 of the cooler portion 11 when the cover portion 22 is in the closed position of FIG. 1.

A seal or gasket (not shown) may be disposed on a surface 145 (see FIG. 7B) of the cover portion 22, and the seal or gasket may be inwardly disposed from the perimeter edge 95 of the cover portion 22. The seal or gasket may sealingly engage a portion of the upper surface 41 (see FIG. 2A) of the main portion 12 when the cover portion 22 is in the closed position of FIG. 1 such that thermal sealing is improved and to prevent the ingress of fluids into (or egress of fluids out of) the interior portion 16 of the cooler portion 11. Alternatively (or in addition), the seal or gasket may be disposed along the upper surface 41 (see FIG. 2A) of the main portion 12 to sealingly engage a portion of the surface 145 (see FIG. 7B) of the cover portion 22.

As illustrated in FIG. 7B, a light 97 may be provided in the cover portion 22 in or on at least one of the one or more interior surfaces 24 of the cover portion 22. For example, the light 97 may be a battery operated or solar operated light that may be disposed in a pocket formed in the one or more interior surfaces 24 of the cover portion 22. In some embodiments, the light may be permanently disposed in the cover portion 22 or may be removably from the cover portion 22. In some embodiments, the light 97 may be connected to one or more sensors such that the light is activated when the cover portion 22 is displaced from a closed position (as illustrated in FIG. 1) to an open position (as illustrated in FIG. 8), for example. The light 97 may have any suitable shape or configuration, such as the general shape of a trapezoid, as illustrated in FIG. 7B. In other embodiments, the light 97 may have a round or rectangular shape, for example. The light 97 may include one or more LEDs and/or any other suitable source of light. In some embodiments, more than one light 97 may be used.

In some embodiments, and in a manner similar to that of the main portion 12, the cover portion 22 may include one or more insulation materials (not shown) between the one or more interior surfaces 24 and the one or more exterior surfaces 96 of the cover portion. The one or more insulation materials may be any of the insulation materials 45 discussed in relation to the main portion 12. In some embodiments, the one or more insulation materials of the cover portion 22 may be the same as the one or more insulation materials 45 of the main portion 12. In other embodiments, the one or more insulation materials of the cover portion 22 may be different from the one or more insulation materials 45 of the main portion 12. In some embodiments, the cover portion 22 may be solid such that no space exists between the one or more interior surfaces 24 and the one or more exterior surfaces 96. Such embodiments of the cover portion 22 may result when the cover portion 22 is made or fabricated by an injection molding process.

In some embodiments, the cover portion 22 may be pivotably or rotatably coupled to the main portion 12 in any suitable manner such that the cover portion 22 may pivot relative to the main portion 12 between a closed position illustrated in FIG. 1 to an open position illustrated in FIG. 8. For example, the cover portion 22 may be pivotably or rotatably coupled to the main portion 12 by a hinge. More specifically, as illustrated in FIG. 2A, the main portion 12 may include one or more hollow hinge members 98 that may be disposed at the first end 36 of the main portion 12. The one or more hollow hinge members 98 of the main portion 12 may coaxially align with one or more hollow hinge members 99 of the cover portion 22 that may be disposed adjacent to the perimeter edge 95 of the cover portion 22, and a hinge pin (not shown) may be disposed within the one or more hollow hinge members 98, 99 to rotatably couple the cover portion 22 to the main portion 12. As illustrated in FIG. 2A, the one or more hollow hinge members 98 of the main portion 12 may include at least two pairs of hinge members 98 disposed at a top portion of the second side wall 40*b*. As shown in FIGS. 7A and 7B, the one or more hollow hinge members 99 of the cover portion 22 may include a pair of single hinge members 99, and each hinge member 99 of the cover portion 22 is disposed between each pair of hinge members 98 of the main portion 12 to prevent lateral displacement of the cover portion 22 relative to the main portion 12. The hinge pins may be permanently disposed within the hollow hinge members 98, 99 to permanently couple the cover portion 22 to the main portion 12. Alternatively, the hinge pins may be removable from the hollow hinge members 98, 99 to allow the cover portion 22 to be removed from the main portion 12.

As illustrated in FIG. 1, the cover portion 22 may be releasably secured to the main portion 12 by one or more closure members 100. In some embodiments, two closure members 100 may releasably secure the cover portion 22 to the main portion 12. Each closure member 100 may have a closed position (illustrated in FIGS. 1 and 9) in which the closure member 100 secures the cover portion 22 to the main portion 12 and an open position (not shown) in which the closure member 100 is not engaged to one of the cover portion 22 or the main portion 12 to such that the closure member 100 does not secure the cover portion 22 to the main portion 12.

Figure 9:
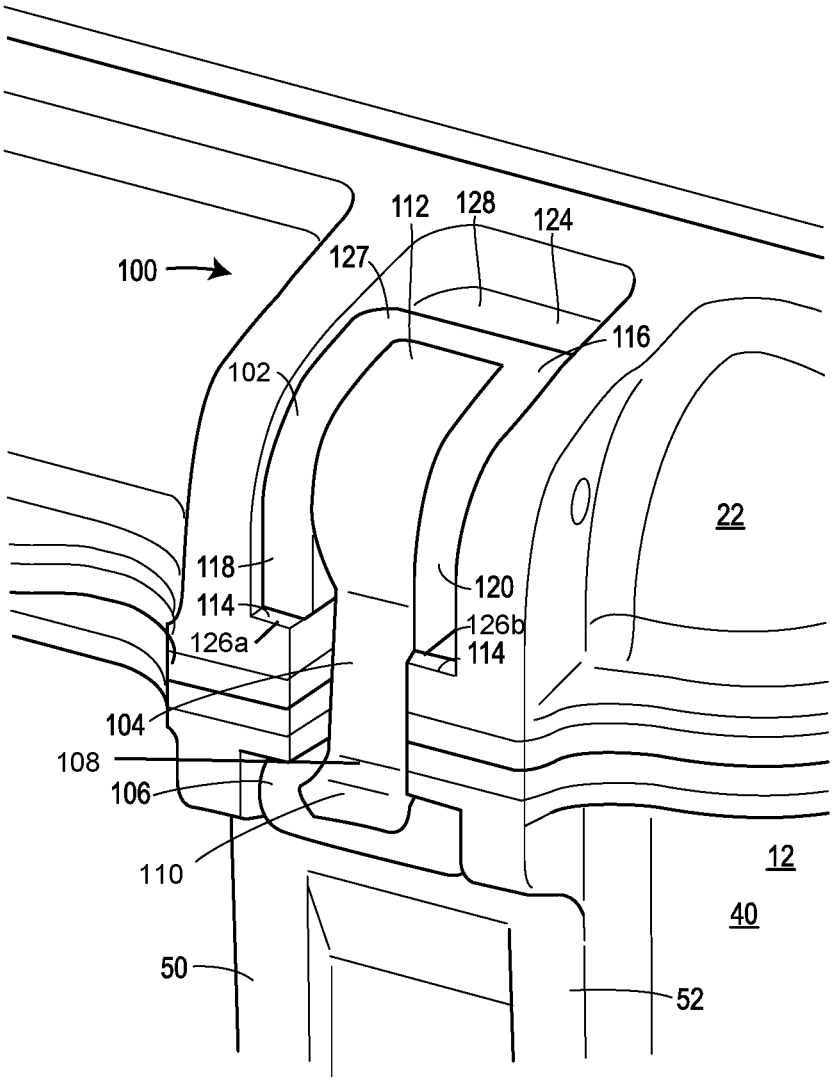
FIG. 9 is a detail of an embodiment of a closure member.

As illustrated in FIG. 9, which is a detail of the closure member 100 illustrated in FIG. 1, each closure member 100 may include a latch member 102, a connection member 104, and a support member 106. The support member 106 may be elongated and may be at least partially disposed in a support recess 108 formed in the main portion 12. The support recess 108 may be disposed between the first lateral ridge 50 and the second lateral ridge 52 of the main portion 12 at or adjacent to the first end 36 of the main portion 12. The support member 106 may be coupled to the main portion 12 in any suitable manner. For example, the support member 106 may be rotatably coupled to the main portion 12 such that the support member 106 may rotate about its longitudinal axis. In some embodiments, a first end of the support member 106 may be rotatably coupled to a first portion of the main portion 12 and a second end of the support member 106 may be rotatably coupled to a first portion of the main portion 12. In some embodiments, the support member 106 may be removably coupled to the main portion 12 such that the closure member 100 may be removed from the main portion 12. In other embodiments, the support member 106 may be permanently coupled to the main portion 12.

The connection member 104 may be coupled to both the support member 106 and the latch member 102. More specifically, the connection member 104 may be elongated, and a first portion 110 of the connection member 104 may be coupled to the support member 106 and have a second portion 112 of the connection member 104 may be coupled to the latch member 102. The first portion 110 of the connection member 104 may be disposed at or adjacent to a first end of the connection member 104 and/or the second portion 112 of the connection member 104 may be disposed at or adjacent to a second end of the connection member 104. In some embodiments, the first portion 110 of the connection member 104 may be rotatably coupled to the support member 106 such that the first portion 110 of the connection member 104 may rotate about a portion of the support member 106. The connection member 104 may be made from a resilient material that may deform or stretch when a force is applied to the first portion 110 in a direction opposite from the second portion 112. In other embodiments, the connection member 104 may be made from a rigid material that may not significantly deform when a force is applied to the first portion 110 in a direction opposite from the second portion 112.

Still referring to FIG. 9, the latch member 102 of the closure member 100 may be elongated, and the latch member 102 may extend from a first end 114 to a second end 116. The first end 114 of the latch member 102 may be adapted to engage one or more portions of the cover portion 22, and the second portion 112 of the connection member may be coupled to a portion of the latch member 102 that may be at or adjacent to the second end 116 of the latch member 102. In some embodiments, the second portion 112 of the connection member 104 may be coupled to a portion of the latch member 102 that may be between the first end 114 and the second end 116 of the latch member 102. In some embodiments, the latch member 102 may have a first arm portion 118 and a second arm portion 120 that each extend from opposite ends of a top portion 127. The top portion 127 may extend along the second end 116 of the latch member 102, and each of the first arm portion 118 and second arm portion 120 extends from the top portion 127 to the first end 114 of the latch member 102. In some embodiments, the first arm portion 118 and a second arm portion 120 may surround or be disposed on opposite sides of the second portion 112 of the connection member 104, and the second end of the connection member 104 may be disposed adjacent to the top portion 127 of the latch member 102.

When the closure member 100 is in the closed position of FIG. 9, the latch member 102 may be at least partially disposed within a latch recess 124 disposed on the cover portion 22. The first end 114 of the latch member 102 may engage a first lip portion 126*a* and/or a second lip portion 126*b* disposed in or adjacent to the latch recess 124 adjacent to the first end 114 of the latch member 102. The first lip portion 126*a* and/or a second lip portion 126*b* is also visible in the perspective view of the cover portion 22 provided in FIG. 7C. In some embodiments, and as illustrated in FIG. 9, an end of the first arm portion 118 of the latch member 102 may engage the first lip portion 126*a* and an end of the second arm portion 120 of the latch member 102 may engage the second lip portion 126*b* when the closure member 100 is in the closed position. In some embodiments, the end of the first arm portion 118 of the latch member 102 and the end of the second arm portion 120 of the latch member 102 may each be rounded and/or may have a reduced thickness to allow the latch member 102 to rotate about a portion of the latch recess 124 at the first lip portion 126*a* and the second lip portion 126*b*. So positioned, the latch member 102 may act as a cam to bias the latch member 102 into a position in which the closure member 100 is in the closed position, and a curved cross-sectional shape of the latch member (when viewed along the axis of the support member, which may be parallel to the X-axis of the reference coordinate system of FIG. 1) and/or a resilient force provided by the connection member 104 may contribute to the latch member 102 being biased into a position in which the closure member 100 is in the closed position. To open the closure member 100, a user may grasp the top portion 127 of the latch member 102 and rotate the top portion 127 away from the cover portion 22 (e.g., away from a bottom surface 128 of the latch recess 124) while the end of the first arm portion 118 of the latch member 102 engages the first lip portion 126*a* and the end of the second arm portion 118 of the latch member 102 engages the second lip portion 126*b*. Once the tension on the cam-shaped latch member 102 is relived (due to a relaxing in tension of the connection member 104, for example), the latch member 102 can be removed from the latch recess 124 to disengage the latch member 102 (and the main portion 12) from the cover portion 22.

To secure the cover portion 22 to the main portion, a user may position the end of the first arm portion 118 of the latch member 102 to engage the first lip portion 126*a* and the end of the second arm portion 118 of the latch member 102 to engage the second lip portion 126*b*. The user may then grasp the top portion 127 of the latch member 102 and rotate the top portion 127 towards the cover portion 22 (e.g., towards from a bottom surface 128 of the latch recess 124) while the end of the first arm portion 118 of the latch member 102 engages the first lip portion 126*a* and the end of the second arm portion 120 of the latch member 102 engages the second lip portion 126*b*. Rotation of the latch member 102 may continue until the top portion 127 of the latch member 102 is disposed in the position illustrated in FIG. 9 in which the top portion 127 is adjacent to the bottom surface 128 of the latch recess 124. Due to the rotation of the cam-shaped latch member 102, the connection member 104 may be lengthened and may provide a force to bias the latch member 102 into a position in which the closure member 100 is in the closed position. As described, the cam-shaped latch member 102 of the closure member 100 provides an easy to engage/disengage coupling device the reliably secures the cover portion 22 to the main portion 12 of the cooler portion 11.

As illustrated in FIGS. 1 and 2A, the cooler portion 11 may include one or more handle portions 48. The one or more handle portions 48 may be coupled to any portion of the main portion 12 or the cover portion 22 to allow a user to lift or move the cooler portion 11. As shown in FIG. 2A, the main portion 12 may include a first handle portion 48*a* and a second handle portion 48*b*, and each of the first handle portion 48*a* and the second handle portion 48*b* may be disposed at or adjacent to the first end 36 of the main portion 12. The first handle portion 48*a* may be disposed at a top portion of the third side wall 40*c* and the second handle portion 48*b* may be disposed at a top portion of the fourth side wall 40*d*. Each of the first handle portion 48*a* and the second handle portion 48*b* may extend in a direction along the X-Y plane of the reference coordinate system of FIG. 2B. Referring again to FIG. 2A, each of the first handle portion 48*a* and the second handle portion 48*b* may include a perimeter portion 49*a*, 49*b* that forms an aperture 51*a*, 51*b* adapted to receive part of a user's hand. Each perimeter portion 49*a*, 49*b* may be rounded or contoured for the user's comfort when the user grasps the corresponding first handle portion 48*a* and the second handle portion 48*b*.

One or more top-mounted accessories may also be removably attached to the top portion 22 in a manner similar to that discussed with respect to FIGS. 4A and 4B. Potential top-mounted accessories attachable to the top portion 22 may include a seat, a padded cushion, a decorative insert, a panel with graphics, a storage container, a storage pouch, a table, a cutting board, a holder for one or more electronic devices, a non-skid surface, a food preparation surface, and/or an interface for attaching other accessories, such as a frame for attaching a cooking device. Similar to FIGS. 4A and 4B, the top-mounted accessory may include a clip portion, similar to clip portion 70*a*, that removably secures to the top portion 22 using a spring force. For example, the top-mounted accessory clip portion may have one or more ends that removably engage a slot 180 formed in or on the top portion 22 (see FIG. 5). A spring force maintains the clip portion of the top-mounted accessory in place during normal use. Beneficially, the top-mounted accessory may be easily removed when not in use and/or may be exchanged with other top-mounted accessories as desired.

Further, one or more accessories may be removably attached to a side of the main portion 12. Potential side-mounted accessories may include a storage container, a storage pouch, a table, a cutting board, a cup holder, a fishing rod holder, a holder for one or more electronic devices, a non-skid surface, a food preparation surface, and/or an interface for attaching other accessories. A side-mounted accessory may contact or engage one or more of the handle 48, the cooler portion 12, and a slot 182 (illustrated in FIG. 5). In one specific example, a removable table accessory rests on top of the handle 48 and includes one or more arms that extend through the hole of the handle 48 down the side of the cooler portion 11 for support. The table accessory arm(s) may each include a lip or finger that extends into the slot 182 in order to keep the table accessory better held in place while in use.

Figure 10:
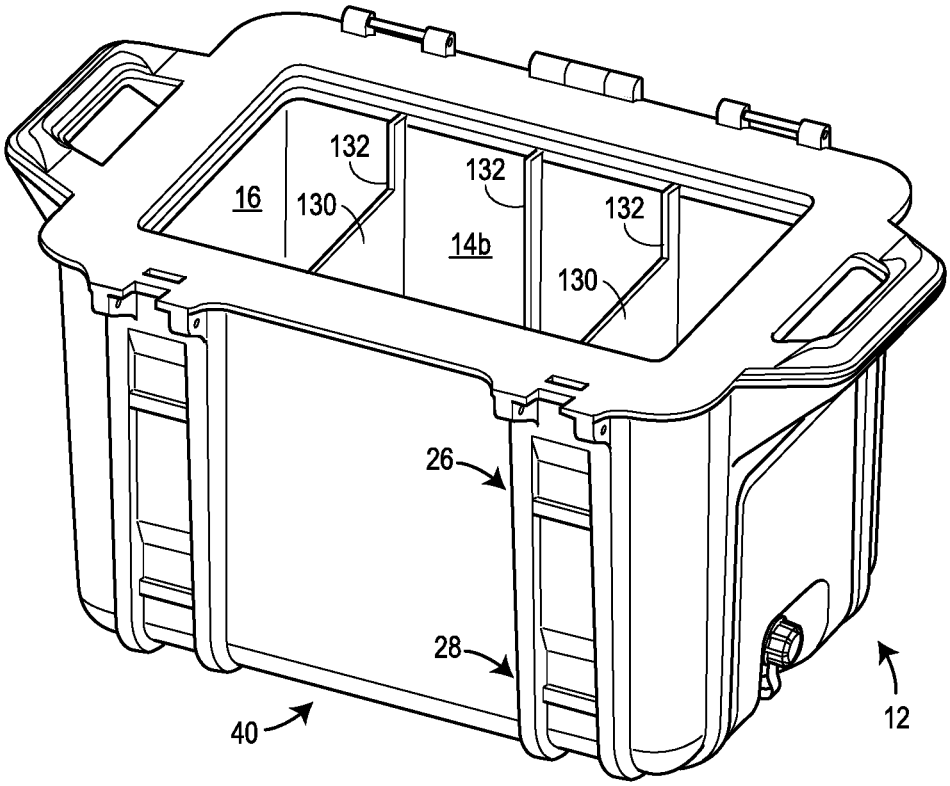
FIG. 10 is a perspective view of an embodiment of the main portion of the cooler portion including two partition members.

As illustrated in FIG. 10, which is a perspective view of an embodiment of the main portion 12, the cooler assembly 10 may additionally include one or more partition members 130 adapted to be slidingly received in one or more partition grooves 132 formed on or in one or more interior surfaces 14 of the main portion 12 of the cooler portion 11. As illustrated in FIG. 2E, which is a cross-sectional view of the main portion 12 taken along section line 2E-2E of FIG. 2B, each of the one or more partition grooves 132 may extend from a top end at or adjacent to the first end 36 of the main portion 12 to a bottom end adjacent to the second end 38 of the main portion 12 and/or at or adjacent to the interior surface 43 of the bottom wall 42. Each of the one or more partition grooves 132 may have any suitable geometry (e.g., depth or width) to allow an edge portion of the partition members 130 to be removably received into the partition grooves 132.

The main portion 12 may include any suitable number of partition grooves 132, such as a single pair of opposing partition grooves 132, two pairs of opposing partition grooves 132, three pairs of opposing partition grooves 132, or more. In some embodiments, and as illustrated in FIG. 2B, a first pair of partition grooves 132*a*, 132*b* may be formed in each of the first side wall interior surface 14*a* and the second side wall interior surface 14*b* and each of the first pair of partition grooves 132*a*, 132*b* may be aligned along a first Y-Z plane 133*a* (of the reference coordinate system of FIG. 2B). A second pair of partition grooves 132*c*, 132*c* may be formed in each of the first side wall interior surface 14*a* and the second side wall interior surface 14*b* and each may be aligned along a second Y-Z plane 133*b* that is offset from the first Y-Z plane 133*a* along the X-axis. A third pair of partition grooves 132*e*, 132*f* may be formed in each of the first side wall interior surface 14*a* and the second side wall interior surface 14*b* and each may be aligned along a third Y-Z plane 133*c* that is offset from the first Y-Z plane 133*a* and second Y-Z plane 133*b* along the X-axis. In some embodiments, any or all of the pairs of opposing partition grooves 132 may have any other orientation, such as aligned along an X-Z plane or in a plane angled relative to both the X-Z plane and the Y-Z plane. In some embodiments, any or all of the partition grooves 132 may not have an opposing partition groove 132.

Figure 11:
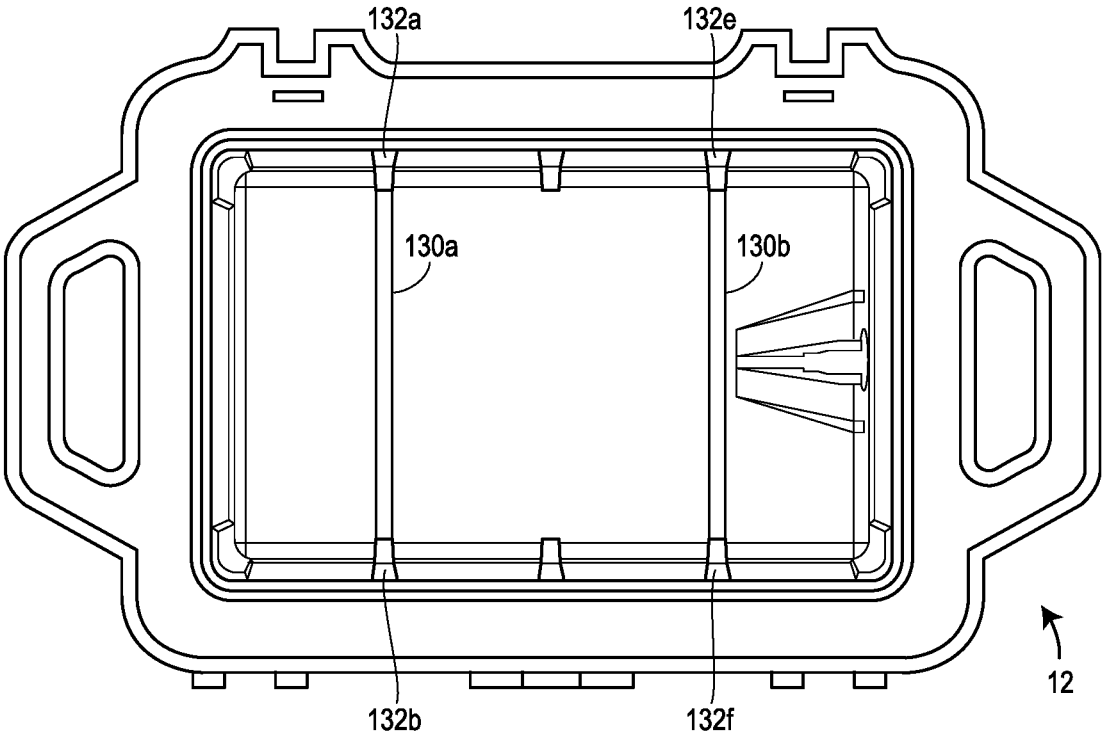
FIG. 11 is a top view of the embodiment of the main portion of FIG. 10.

As illustrated in FIG. 10, the one or more partition members 130 may be received (e.g., slidingly received) into any of the pairs of opposing partition grooves 132 to secure the partition member 130 to the main portion 12. Each partition member 130 may have any suitable size or shape such that at least one edge portion is received in a corresponding partition groove 130. In some embodiments, as illustrated in the top view of an embodiment of the main portion 12 provided in FIG. 11, a first partition member 130*a* may be planar or substantially planar and may extend between the first pair of partition grooves 132*a*, 132*b* such that a first end portion of the first partition member 130*a* may be disposed in one of the first pair of partition grooves 132*a* and a second end portion of the first partition member 130*a* may be disposed in the other of the first pair of partition grooves 132*a*, 132*b*. A second partition member 130*b* may be planar or substantially planar and may extend between the third pair of partition grooves 132*e*, 132*f* such that a first end portion of the second partition member 130*b* may be disposed in one of the third pair of partition grooves 132*e* and a second end portion of the third partition member 130*f* may be disposed in the other of the third pair of partition grooves 132*e*, 132*f*. A third partition member (not shown) may be planar and may extend between the second pair of partition grooves 132*c*, 132*d* in the same manner as the first partition member 130*a* and the second partition member 130*b*, as may any additional partition members 130 in additional partition grooves 132. Partition members may extend (along the Z-axis) from a bottom end disposed at or adjacent to a bottom end of the partition groove 132 to a top end that may be disposed at or the top end of the partition groove 132. In some embodiments, including that illustrated in FIG. 10, the top end of the partition member 130 may be disposed between the top end of the partition groove 132 and the bottom end of the partition groove 132. In some embodiments, the top end of the partition member 130 may be disposed beyond the top end of the partition groove 132.

To insert the partition member 130 in the partition grooves 132 (for example, to insert the first partition member 130*a* in the first pair of partition grooves 132*a*, 132*b*), the first end portion of the first partition member 130*a* may be aligned with one of the first pair of partition grooves 132*a* and the second end portion of the first partition member 130*a* may be aligned with the other of the first pair of partition grooves 132*a*, 132*b*. So positioned, the first partition member 130*a* may be downwardly displaced into the first pair of partition grooves 132*a* such that the bottom end of the first partition member 130*a* is disposed at or adjacent to a bottom end of the partition groove 132. The process is reversed to remove the first partition member 130 from the main portion 12.

With a desired number of partition members 130 disposed in the main portion 12, any suitable number of compartments may be created in the interior portion 16. For example, alcoholic beverages may be disposed in a first compartment, carbonated beverages may be disposed in a second compartment, and food may be disposed in a third compartment. The user can then easily find a desired item without searching within a pool of ice water for the item. In addition, the first end portion of the first partition member 130*a* may sealingly engage one of the first pair of partition grooves 132*a* and the second end portion of the first partition member 130*a* may sealingly engage the other of the first pair of partition grooves 132*a*, 132*b* to create a sealed compartment such that ice water may be disposed in the sealed compartment (for alcoholic beverages for example) and ice packs may be disposed in a dry compartment (for bread and lunchmeat, for example), thereby efficiently consolidating space for multiple types of stored items.

Figure 12A:
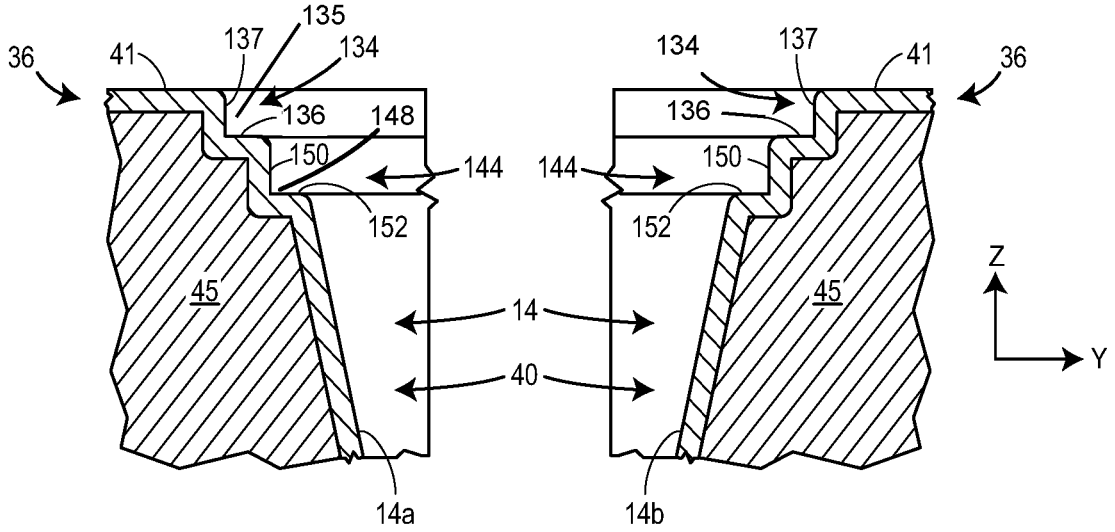
FIG. 12A is a partial cross-sectional view of an embodiment of the main portion having a first tray recess and a second tray recess.
Figure 12B:
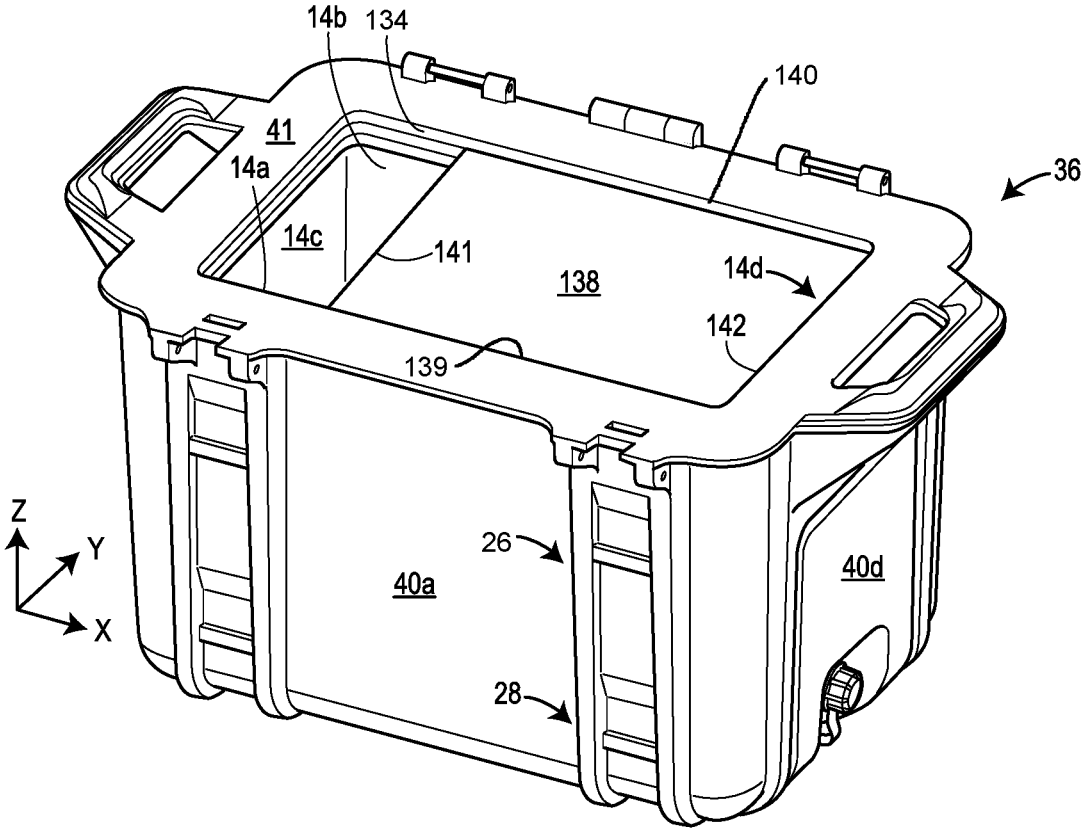
FIG. 12B is a perspective view of an embodiment of the main portion of FIG. 12A having a first tray in the first tray recess.

As illustrated in FIG. 2A, the main portion 12 may also include a first tray recess 134 around a perimeter portion of the one or more interior surfaces 14 of the one or more side walls 40 at or adjacent to the open first end 36 of the main portion 12. As illustrated in FIG. 12A, which is a partial cross-sectional view of an embodiment of the main portion 12, the first tray recess 134 may include a first shoulder portion 135 formed by a first outer wall 137 and a first ledge 136 that extends away from the first outer wall 137. The first tray recess 134 may extend around an entire perimeter of the one or more side walls 40 at or adjacent to the open first end 36. The first ledge 136 may provide a support for a first tray 138, which is illustrated in the perspective view of an embodiment of the main portion 12 of FIG. 12B. The first tray 138 may be planar or substantially planar and may have a dimension that allows opposing end portions to rest on opposing portions of the first ledge 136, as illustrated in FIG. 12B. For example, the first tray 138 may have a width dimension (e.g., a dimension along the Y-axis of the reference coordinate system of FIG. 12B) such that a first lateral end portion 139 is supported by a portion of the first ledge 136 extending along the first side wall interior surface 14*a* and a second lateral end portion 140 is supported by a portion of the first ledge 136 extending along the second side wall interior surface 14*b*. As illustrated in FIG. 12B, the first tray 138 may have a length dimension (e.g., a dimension along the X-axis of the reference coordinate system of FIG. 12B) such that a distance between a first main end portion 141 and a second main end portion 142 is less that (e.g., 20% to 80% less than) a distance between the third side wall interior surface 14*c* and the fourth side wall interior surface 14*d* taken at the first end 36 of the main portion 12 along the X-axis of the reference coordinate system of FIG. 12B. So configured, the first tray 138 may slide along the first tray recess 134 to a desired position.

In other embodiments, the first tray 138 may have a length dimension such that a distance between the first main end portion 141 and the second main end portion 142 is slightly less than (e.g., 2% to 5% less than) the distance between the third side wall interior surface 14*c* and the fourth side wall interior surface 14*d* taken at the first end 36 of the main portion 12 along the X-axis of the reference coordinate system of FIG. 12B. So configured, the first tray 138 may cover the entire open first end 36 of the main portion 12. That is, the first lateral end portion 139 may be supported by a portion of the first ledge 136 extending along the first side wall interior surface 14*a*, the second lateral end portion 140 may be supported by a portion of the first ledge 136 extending along the second side wall interior surface 14*b*, the first main end portion 141 may be supported by a portion of the first ledge 136 extending along the third side wall interior surface 14*c*, and the second main end portion 142 may be supported by a portion of the first ledge 136 extending along the fourth side wall interior surface 14*d*.

Figure 12C:
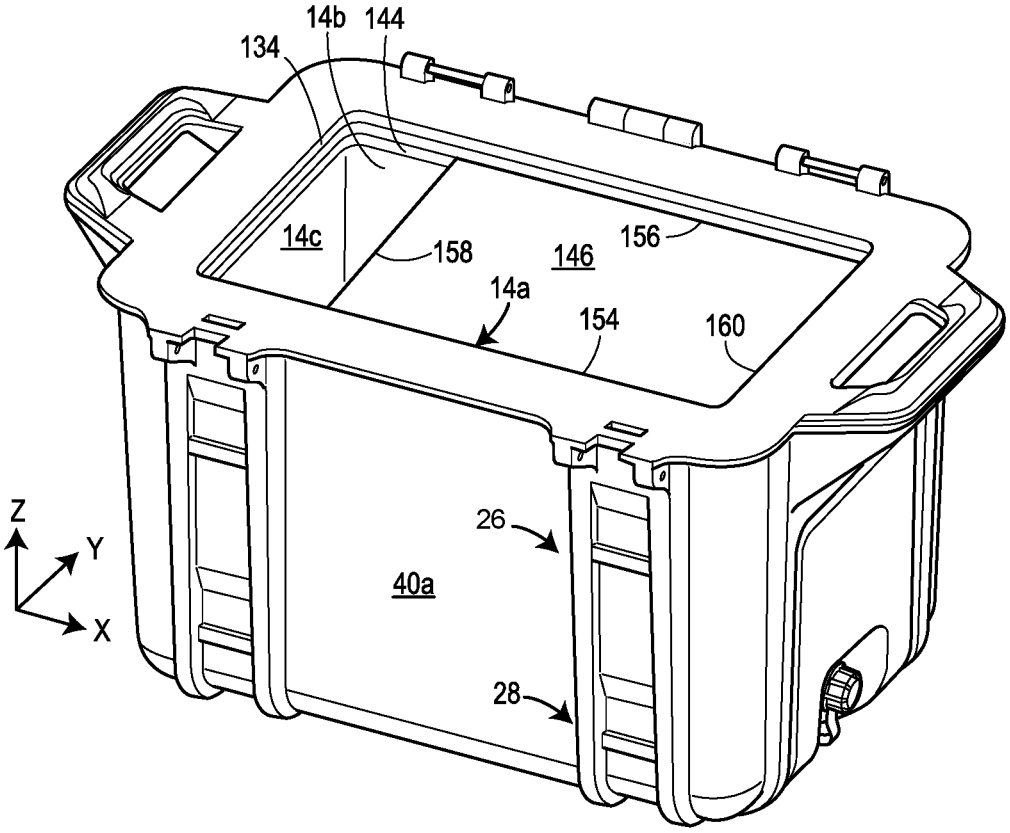
FIG. 12C is a perspective view of an embodiment of the main portion of FIG. 12A having a second tray in the second tray recess.

As illustrated in FIG. 2A, the main portion 12 may additionally include a second tray recess 144 around a perimeter portion of the one or more interior surfaces 14 of the one or more side walls 40 at or adjacent to the open first end 36 of the main portion 12. As illustrated in FIG. 12A, the second tray recess 144 may include a second shoulder portion 148 formed by a second outer wall 150 and a second ledge 152 that extends away from the second outer wall 150. The second tray recess 144 may extend around an entire perimeter of the one or more side walls 40 at or adjacent to the open first end 36. The second ledge 152 may provide a support for a second tray 146, which is illustrated in the perspective view of an embodiment of the main portion 12 of FIG. 12C. The second tray 146 may be planar or substantially planar and may have a dimension that allows opposing end portions to rest on opposing portions of the second ledge 152, as illustrated in FIG. 12C. For example, the second tray 146 may have a width dimension (e.g., a dimension along the Y-axis of the reference coordinate system of FIG. 12B) such that a first lateral end portion 154 is supported by a portion of the second ledge 152 extending along the first side wall interior surface 14*a* and a second lateral end portion 156 is supported by a portion of the second ledge 152 extending along the second side wall interior surface 14*b*. As illustrated in FIG. 12C, the second tray 146 may have a length dimension (e.g., a dimension along the X-axis of the reference coordinate system of FIG. 12B) such that a distance between a first main end portion 158 and a second main end portion 160 is less that (e.g., 20% to 80% less than) a distance between the third side wall interior surface 14*c* and the fourth side wall interior surface 14*d* taken at the first end 36 of the main portion 12 along the X-axis of the reference coordinate system of FIG. 12B. So configured, the second tray 146 may slide along the second tray recess 144 to a desired position.

In other embodiments, the second tray 146 may have a length dimension such that a distance between the first main end portion 158 and the second main end portion 160 is slightly less than (e.g., 2% to 5% less than) the distance between the third side wall interior surface 14*c* and the fourth side wall interior surface 14*d* taken at the first end 36 of the main portion 12 along the X-axis of the reference coordinate system of FIG. 12B. So configured, the second tray 146 may cover the entire open first end 36 of the main portion 12. That is, the first lateral end portion 154 may be supported by a portion of the second ledge 152 extending along the first side wall interior surface 14*a*, the second lateral end portion 156 may be supported by a portion of the second ledge 152 extending along the second side wall interior surface 14*b*, the first main end portion 158 may be supported by a portion of the second ledge 152 extending along the third side wall interior surface 14*c*, and the second main end portion 160 may be supported by a portion of the second ledge 152 extending along the fourth side wall interior surface 14*d*.

The first tray 138 and the second tray 146 may have any suitable thickness. In some embodiments, the first tray 138 may have a thickness such that a top surface of the first tray 138 is coplanar or substantially coplanar with the upper surface 41 of the main portion 12 to maximize a working surface provided by the top surface of the first tray 138 and the upper surface 41 of the main portion 12. In some embodiments, the second tray 146 may have a thickness such that the second tray 146 may be disposed in the second tray recess 144 while the first tray 138 is disposed in the first tray recess 134 for storage. In some embodiments, one or more of the partition members 130 may also be used as the first tray 138 and/or the second tray 146 (and vice versa).

So configured, the first tray 138 and/or the second tray 146 may provide a convenient working surface when preparing food or beverages while using the cooler assembly 10. For example, the first tray 138 and/or the second tray 146 may act as a cutting board for the chopping of food or may act as a table or support In some examples, the cooler assembly 10 may include one or more temperature sensors and/or temperature indication devices. A temperature sensor may measure a temperature at one or more locations internal to cooler assembly 10 and provide information about the measured temperature(s), thereby enabling a user to get information about the temperature(s) without necessarily having to open the cooler portion 11. The temperature information may be transferred or transmitted to a temperature indication device that is on an outside surface of the cooler portion 11. The temperature information may be transferred through a wired, wireless, fluidic, and/or mechanical connection. In other examples, the temperature information may be transferred to a remote device, such as to a smartphone or another computing device. In one specific example, the temperature information may be transferred through a BLUETOOTH connection, or through a similar wireless connection, to a software application running on a smartphone. In other examples, the information may be transferred to a remote computing device over a cellular network and/or over the Internet.

While various embodiments have been described above, this disclosure is not intended to be limited thereto. Variations can be made to the disclosed embodiments that are still within the scope of the appended claims.

What is claimed is:

1. A cooler assembly for the storage of one or more objects, the cooler assembly comprising:

a cooler portion, the cooler portion comprising:

a main portion having one or more side walls having one or more interior surfaces that at least partially define an interior portion that is adapted to receive the one or more objects, wherein one or more exterior surfaces of the one or more side walls of the main portion define an exterior portion of the cooler portion, wherein the main portion includes (i) a first tray recess around a perimeter portion of the one or more interior surfaces of the one or more side walls at or adjacent to an open first end of the main portion and (ii) a second tray recess around the perimeter portion of the one or more interior surfaces of the one or more side walls at or adjacent to the open first end of the main portion;

a cover portion pivotably coupled to the main portion by a hinge, wherein the cover portion is releasably secured to the main portion by one or more closure members, and each of the one or more closure members includes a support member coupled to the main portion, a latch member removably coupled to the cover portion, and a connection member having a first portion coupled to the support member and a second portion coupled to the latch member, wherein the latch member of each of the one or more closure members is a cam that biases the latch member into a position in which the closure member is in a closed position, wherein when the cover portion is in a closed position relative to the main portion, one or more interior surfaces of the cover portion at least partially define the interior portion;

a first main portion securement feature disposed at a first location on at least one of the one or more side walls of the main portion; and a second main portion securement feature disposed at a second location on at least one of the one or more side walls of the main portion; and a first attachment assembly, the first attachment assembly having a first attachment securement feature adapted to releasably engage the first main portion securement feature or the second main portion securement feature to removably secure the first attachment assembly to at least one of the one or more side walls of the main portion.

2. The cooler assembly of claim 1, further comprising:

a second attachment assembly, the second attachment assembly having a second attachment securement feature adapted to releasably engage the first main portion securement feature or the second main portion securement feature to removably secure the second attachment assembly to at least one of the one or more side walls of the main portion.

3. The cooler assembly of claim 2, wherein the first attachment securement feature is substantially identical to the second attachment securement feature.

4. The cooler assembly of claim 2, wherein the second attachment assembly includes an accessory portion and a clip portion removably secured to the accessory portion, and wherein the second attachment securement feature is disposed on the clip portion.

5. The cooler assembly of claim 4, wherein a first clip arm of the clip portion of the second attachment assembly includes a lip disposed at or adjacent to an end portion of the first clip arm, and the lip removably engages a slot formed in or on a first end of the accessory portion of the second attachment assembly to secure the clip portion to the accessory portion.

6. The cooler assembly of claim 2, wherein the second attachment securement feature includes at least one retaining arm adapted to releasably engage the first main portion securement feature or the second main portion securement feature.

7. The cooler assembly of claim 1, wherein the one or more side walls each extends in a direction along a main portion axis from a first end to a second end, and wherein the one or more side walls includes four side walls that cooperate to form a rectangular shape when viewed along the main portion axis.

8. The cooler assembly of claim 1, wherein the one or more side walls includes one or more insulation materials between the one or more interior surfaces and the one or more exterior surfaces.

9. The cooler assembly of claim 1, wherein the first main portion securement feature includes a first bar portion that is offset from a first portion of one or more of the exterior surfaces of the one or more side walls, and wherein the second main portion securement feature includes a second bar portion that is offset from a second portion of one or more of the exterior surfaces of the one or more side walls.

10. The cooler assembly of claim 9, wherein all or a portion of the first bar portion has a rectangular cross-sectional shape and all or a portion of the second bar portion has a rectangular cross-sectional shape.

11. The cooler assembly of claim 9, wherein each of the first bar portion and the second bar portion is secured between a first lateral ridge and a second lateral ridge, and wherein each of the first lateral ridge and the second lateral ridge is elongated and extends in a direction from a first point at or adjacent to a first end of the main portion to a second point at or adjacent to the second end of the main portion.

12. The cooler assembly of claim 1, wherein the first attachment assembly includes an accessory portion and a clip portion removably secured to the accessory portion, and wherein the first attachment securement feature is disposed on the clip portion.

13. The cooler assembly of claim 12, wherein the accessory portion of the first attachment assembly includes a container adapted to be opened and closed.

14. The cooler assembly of claim 12, wherein a first clip arm of the clip portion of the first attachment assembly includes a lip disposed at or adjacent to an end portion of the first clip arm, and the lip removably engages a slot formed in or on a first end of the accessory portion of the first attachment assembly to secure the clip portion to the accessory portion.

15. The cooler assembly of claim 1, wherein the first attachment securement feature includes at least one retaining arm adapted to releasably engage the first main portion securement feature or the second main portion securement feature.

16. The cooler assembly of claim 1, wherein a light is disposed in at least one of the one or more interior surfaces of the cover portion.

17. The cooler assembly of claim 1, further comprising:

one or more partition members adapted to be slidingly received in one or more partition grooves formed on or in at least one of the one or more interior surfaces of the main portion of the cooler portion.

18. The cooler assembly of claim 17, wherein each of the one or more partition members is planar and is slidingly received into an opposing pair of the one or more partition grooves to secure the partition member to the main portion.

19. The cooler assembly of claim 1, further comprising:

a first tray having opposing end portions received on opposing portions of a first ledge of the first tray recess.

20. The cooler assembly of claim 19, further comprising:

a second tray having opposing end portions received on opposing portions of a second ledge of the second tray recess.

21. The cooler assembly of claim 20, wherein the opposing end portions of the first tray correspond to a first width dimension of the first tray and the opposing end portions of the second tray correspond to a second width dimension of the second tray, and wherein the first width dimension is greater than the second width dimension.

22. The cooler assembly of claim 21, wherein when the first tray has the opposing end portions received on the opposing portions of the first ledge of the first tray recess and when the second tray has the opposing end portions received on opposing portions of the second ledge of the second tray recess, the first tray has a bottom surface that is offset from a top surface of the second tray along a main portion axis.

23. The cooler assembly of claim 1, wherein the first main portion securement feature is substantially identical to the second main portion securement feature.

24. The cooler assembly of claim 1, wherein the first tray recess includes a first outer wall and a first ledge that extends away from the first outer wall and the second tray recess includes a second outer wall and a second ledge that extends away from the second outer wall, wherein the first ledge is offset from the second ledge along a main portion axis.

25. A cooler portion for the storage of one or more objects, the cooler portion comprising:

a main portion having one or more side walls having one or more interior surfaces that at least partially define an interior portion that is adapted to receive the one or more objects, wherein one or more exterior surfaces of the one or more side walls of the main portion define an exterior portion of the cooler portion;

a cover portion at least one of pivotably coupled to or removably secured to the main portion, wherein when the cover portion is in a closed position relative to the main portion, one or more interior surfaces of the cover portion cooperate to at least partially define the interior portion;

one or more closure members coupled to at least one of the cover portion or the main portion, the one or more closure members adapted to releasably secure the cover portion to the main portion, wherein each of the one or more closure members includes a support member coupled to the main portion, a latch member removably coupled to the cover portion, and a connection member having a first portion coupled to the support member and a second portion coupled to the latch member, wherein the latch member of each of the one or more closure members includes a cam that biases the latch member into a position in which the closure member is in a closed position;

a first main portion securement feature disposed at a first location on at least one of the one or more side walls of the main portion, the first main portion securement feature adapted to releasably engage a first attachment securement feature of a first attachment assembly and adapted to releasably engage a second attachment securement feature of a second attachment assembly; and a second main portion securement feature disposed at a second location on at least one of the one or more side walls of the main portion, the second main portion securement feature adapted to releasably engage the first attachment securement feature of the first attachment assembly and adapted to releasably engage the second attachment securement feature of the second attachment assembly, wherein the first main portion securement feature includes a first bar portion that is offset from a first portion of one or more of the exterior surfaces of the one or more side walls, and wherein the second main portion securement feature includes a second bar portion that is offset from a second portion of one or more of the exterior surfaces of the one or more side walls.

26. The cooler portion of claim 25, wherein all or a portion of the first bar portion has a rectangular cross-sectional shape and all or a portion of the second bar portion has a rectangular cross-sectional shape.

27. The cooler portion of claim 25, wherein each of the first bar portion and the second bar portion is secured between a first lateral ridge and a second lateral ridge, and wherein each of the first lateral ridge and the second lateral ridge is elongated and extends in a direction from a first point at or adjacent to a first end of the main portion to a second point at or adjacent to the second end of the main portion.

28. The cooler portion of claim 25, wherein a light is disposed in at least one of the one or more interior surfaces of the cover portion.

29. The cooler portion of claim 25, wherein the cover portion is pivotably coupled to the main portion by a hinge.

30. The cooler portion of claim 25, further comprising:

one or more partition members adapted to be slidingly received in one or more partition grooves formed on or in at least one of the one or more interior surfaces of the main portion.

31. The cooler portion of claim 30, wherein each of the one or more partition members is planar and is slidingly received into an opposing pair of the one or more partition grooves to secure the partition member to the main portion.

32. The cooler portion of claim 25, wherein the main portion includes a first tray recess around a perimeter portion of the one or more interior surfaces of the one or more side walls at or adjacent to an open first end of the main portion.

33. The cooler portion of claim 32, further comprising:

a first tray having opposing end portions received on opposing portions of a first ledge of the first tray recess.

34. The cooler portion of claim 33, wherein the main portion includes a second tray recess around the perimeter portion of the one or more interior surfaces of the one or more side walls at or adjacent to an open first end of the main portion.

35. The cooler portion of claim 34, further comprising:

a second tray having opposing end portions received on opposing portions of a second ledge of the second tray recess.

36. The cooler portion of claim 25, wherein the first main portion securement feature is substantially identical to the second main portion securement feature.

37. The cooler portion of claim 25, wherein the one or more side walls each extends in a direction along a main portion axis from a first end to a second end, and wherein the one or more side walls includes four side walls that cooperate to form a rectangular shape when viewed along the main portion axis.

38. The cooler portion of claim 25, wherein the one or more side walls includes one or more insulation materials between the one or more interior surfaces and the one or more exterior surfaces.

* * * * *